US012091850B2

(12) United States Patent
Levy et al.

(10) Patent No.: US 12,091,850 B2
(45) Date of Patent: Sep. 17, 2024

(54) EXPANDABLE ROOM DIVIDERS

(71) Applicant: NPS Public Furniture Corp., Clifton, NJ (US)

(72) Inventors: Elliot Levy, Passaic, NJ (US); Alexander Crudo, Hoboken, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 483 days.

(21) Appl. No.: 17/491,735

(22) Filed: Oct. 1, 2021

(65) Prior Publication Data

US 2022/0106787 A1 Apr. 7, 2022

Related U.S. Application Data

(63) Continuation-in-part of application No. 29/753,757, filed on Oct. 1, 2020, now Pat. No. Des. 945,781.

(51) Int. Cl.
*A47G 5/00* (2006.01)
*E04B 2/74* (2006.01)

(52) U.S. Cl.
CPC ..... *E04B 2/7427* (2013.01)

(58) Field of Classification Search
CPC ..... A47G 5/00; E04B 2/7427; E04B 2/7431; E05C 1/00; E05C 1/004; E05C 1/006; E05C 1/08; E05C 1/085; E05C 1/12; E05C 1/14; E05C 1/145; E05B 7/00
USPC ..... 160/351, 352, 218, 229.1; 52/71, 238.1
See application file for complete search history.

(56) References Cited

U.S. PATENT DOCUMENTS 2,219,586 A * 10/1940 Blewett ..... B30B 9/3032 100/223
4,546,628 A * 10/1985 Takasaki ..... E05B 65/0053 70/210
4,932,172 A * 6/1990 Maas ..... E04B 2/7427 312/297

(Continued)

OTHER PUBLICATIONS

"Screenflex Standard Room Divider" Retrieved from Internet: URL: https://www.accordron-doors.com/product/screenflex-standard-room-divider/, Sep. 21, 2020.

*Primary Examiner* — Johnnie A. Shablack
*Assistant Examiner* — Matthew R. Shepherd
(74) *Attorney, Agent, or Firm* — Weiss & Arons LLP

(57) ABSTRACT

Systems and methods for deployment, storage, transport of expandable room dividers. The systems may include a frame configured to lock room divider panels compactly stacked against each other for storage and transport. The frame may retain a non-releasable panel and maintain it vertically upright. That panel may be hinged along a non-retained vertical edge to a closest of a plurality of panels movable with respect to the non-releasable panel. The plurality's panels are serially hinged together, accordion-like, along vertical edges. Hinge angles between adjacent stacked panels are approximately zero degrees. Movable panels are sequentially moved from the frame by user-control opening a locking mechanism. Hinge angles between adjacent panels of the plurality of moved panels, and between the non-releasable panel and its adjacent movable panel, are increased to expand the room divider. The locking mechanism gates return of panels to, and when unopened blocks their movement from, the non-releasable panel.

19 Claims, 17 Drawing Sheets

(56) References Cited

U.S. PATENT DOCUMENTS

| | | | | |
|---|---|---|---|---|
| 5,272,848 | A * | 12/1993 | Maas | A47G 5/00 160/135 |
| 6,009,930 | A * | 1/2000 | Jantschek | E04B 2/7431 160/352 |
| D422,796 | S | 4/2000 | Milligan et al. | |
| 6,532,703 | B1 * | 3/2003 | Barrens | E06B 7/02 52/204.1 |
| D669,693 | S | 10/2012 | Göranson et al. | |
| 2002/0108330 | A1 | 8/2002 | Yu et al. | |
| 2003/0047292 | A1 | 3/2003 | Fritsche et al. | |
| 2004/0173325 | A1 * | 9/2004 | Maas | A47G 5/00 160/135 |
| 2005/0223665 | A1 * | 10/2005 | Maas | E04H 1/1272 52/239 |
| 2008/0086964 | A1 * | 4/2008 | Hardt | E04B 2/7427 52/239 |
| 2009/0000750 | A1 * | 1/2009 | Hardt, II | E04B 2/7431 160/351 |
| 2009/0178543 | A1 * | 7/2009 | Lee | H04N 21/43072 84/610 |
| 2009/0250176 | A1 * | 10/2009 | Ryan | E04B 2/7425 160/222 |
| 2012/0006498 | A1 * | 1/2012 | Potter | E04F 11/1851 160/368.1 |
| 2019/0023159 | A1 * | 1/2019 | Setlur | B60N 2/919 |

* cited by examiner

EXPANDABLE ROOM DIVIDERS

CROSS-REFERENCE TO OTHER APPLICATIONS

This application is a Continuation-in-Part of U.S. patent application Ser. No. 29/753,757, filed on Oct. 1, 2020, which is hereby incorporated by reference herein in its entirety.

FIELD OF TECHNOLOGY

Aspects of the disclosure relate to the deployment of expandable room dividers to resolve ergonomic issues of partitioning open spaces, and to the transport and compact storage of such expandable room dividers.

BACKGROUND OF THE DISCLOSURE

Various venues featuring open spaces, particular indoor open spaces, often need to be divided into discrete regions partitioned from each other. Such regions may need to be reconfigured to accommodate changing needs.

Sections of hotels and conference/convention centers may need to be partitioned on short notice into exhibit booths, waiting lines and lecture/discussion/viewing areas for an exhibition/event. Post-exhibition/post-event, such areas may need to be rapidly transformed back to minimally divided open space for efficiency of cleaning and for ease of reconfiguration for subsequent exhibitions/events. The same is often true of school gymnasium facilities, sporting arenas, arcades and even parking lots converted, usually temporarily but often periodically, into crowd-handling spaces, such as balloting centers and mass medical testing/examination/treatment sites.

At medical testing/examination/treatment sites, pressing and often changing considerations of patient privacy and/or modesty may be well served by systems of expanded room dividers that are compactly stored, readily transported, easily deployed and un-deployed, and rapidly configured and re-configured. At such sites, modularity and transportability of partitioning components such as panels may also be called for so as to facilitate adequate sterilization between cohorts of patients.

Enterprise office floors may need central cubical courts to be divided and, sometimes, to then be reconfigured to accommodate changing employer guidelines and employee numbers. Temporary or rental offices may need to be prepared for ready configuring to accommodate different employer identities and their attendant different corporate cultures, procedures and needs.

The above-mentioned examples and other such examples may benefit from the availability of expanded room dividers that are compactly stored, readily transported, easily deployed and un-deployed, and rapidly configured and re-configured in their expanded forms. Other such examples may include manufacturing facilities making, processing and/or packaging new product lines, medical or otherwise, that require partitioning from existing lines to meet applicable industry, safety and/or government regulations. Other such examples may include immigration centers and customs facilities that need to be readily responsive to sequestration requirements of peoples and products entering and exiting sovereign states.

Typically, currently available room partitioning systems are deficient in one, and often in more than one, of the characteristics of compact storage, ready transportability, easy deployment and un-deployment, and rapid configurability and re-configurability.

Accordingly, it would be desirable to provide partitioning systems that offer expandable room dividers that are compactly stored, readily transported, easily deployed and un-deployed, and rapidly configured and re-configured. It would be further desirable to provide methods for the efficient use of such partitioning systems. (Hereinafter, an expanded room divider may be termed, in the alternative, an extended room divider.)

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
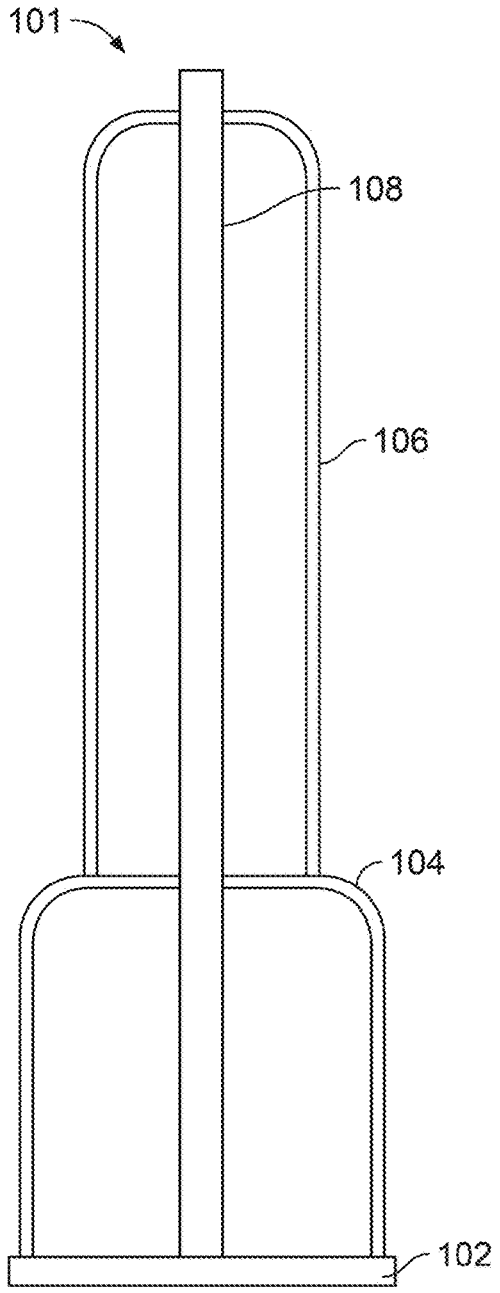
FIG. 1 shows, end-on, an illustrative frame in accordance with principles of the invention.

Aspects of the disclosure relate to systems and methods for ready deployment and configuring of expandable room dividers, for the secure and compact storage of divider components, facilitating transport and redeployment. The systems may be used to perform one or more steps of the methods. A system of the systems may be a mechanical system. The system may provide an expandable room divider.

The system may include a frame. The frame may be configured to retain a non-releasable panel. The frame may be configured to permanently retain the non-releasable panel. The non-releasable panel may be affixed to the frame. The non-releasable panel may be affixed perpendicularly to the frame. The non-releasable panel may be affixed non-perpendicularly to the frame.

The frame may include a bottom crosspiece beam. The bottom beam may be equipped with wheels. The wheels may be spring-loaded. The wheels may swivel. The wheels may be gimbal-mounted. The wheels may be lockable.

The frame may be configured to accommodate a plurality of movable panels. The movable panels may be stacked against a broad side of the non-releasable panel. The movable panels may be moved relative to the frame. The movable panels may be moved relative to the non-releasable panel. The movable panels may be moved toward the non-releasable panel. The movable panels may be moved away from the non-releasable panel. The movable panels may be secured against the non-releasable panel. The movable panels may be secured in a stack in a stack against the non-releasable panel. The movable panels may be released from the stack. (Hereinafter, a panel—releasable or non-releasable, movable or non-movable, in or out of a stack—may, in the alternative, be termed a room partition.)

In operation, the frame may retain the non-releasable panel and maintain it vertically upright. The non-releasable panel may be hinged to a movable panel of the plurality along a vertical edge of the non-releasable panel. The movable panels of the plurality may be serially hinged, accordion-like, together.

The panels may be vertically upright. The panels may stand at six feet tall in height. The panels may stand at less than six feet tall in height. The panels may stand at more than six feet tall in height. The panels may be of mixed heights. The non-releasable panel may be seven feet tall and the movable panels may be four and one-half feet tall. The non-releasable panel may be five feet tall in height and the movable panels may be five and one half feet tall. A first non-releasable panel may be six feet tall; four movable panels in line between the first non-releasable panel and a second non-releasable panel may, sequentially, be of six feet, five feet, five feet and six feet; the second non-releasable panel may be six feet tall. Other heights and combination of heights are anticipated.

The panels may be three feet in width. The panels may be less than three feet in width. The panels may be more than three feet in width. The panels may be of mixed widths.

The panels may feature walls that are opaque. The panels may feature walls that include fabric covering. The panels may feature walls that are transparent. The panels may feature walls that include plexiglass. The panels may feature walls that are translucent.

The panels may feature walls that are single colored. The panels may feature walls that are multi-colored. Coloring of the walls may include blue. Coloring of the walls may include maroon. Coloring of the walls may include any color.

The panels may feature walls that include apertures. The apertures may traverse the thickness of the panels. The apertures may be selectively closeable and openable.

The system may include a locking mechanism. The locking mechanism may be configured to selectively prevent movement of the plurality of movable panels from the frame. The locking mechanism may be configured to selectively allow movement of the plurality of movable panels from the frame. The locking mechanism may be termed a system locking mechanism.

The locking mechanism may have a longitudinal axis. The mechanism may include a plunger disposed coaxial with the longitudinal axis. The plunger may be configured to travel along the longitudinal axis. The plunger may have a head at a first end of the plunger.

The locking mechanism may include a spring. The spring may be configured to longitudinally bias the plunger to a forward location in the direction of the head.

The locking mechanism may include an actuator. The actuator may include a handle, a foot pedal or any other suitable device. The actuator may be linked to the plunger at a second end of the plunger. The second end of the plunger may be disposed away from the first end. The actuator may be configured to receive application of a force. The force may be sufficient to counter the spring. The force may be sufficient to draw the plunger back in the direction of the second end.

The locking mechanism may include a body. The body may be configured to support the plunger. The body may be configured to support the spring. The body may be configured to support the actuator. The body may be configured to receive the head as the plunger travels back in the direction of the second end.

The locking mechanism may be affixed to the frame. The mechanism may be affixed to the frame with the longitudinal axis of the mechanism disposed parallel the broad side of the non-releasable panel.

A first face of the head may be configured to prevent movement of the moveable panels away from the non-releasable panel. The first face of the head may be configured to prevent movement of the moveable panels away from the non-releasable panel when the head is maintained in the forward location.

A second face of the head may be obverse the first face. The second face may be configured to allow movement of the moveable panels past the body in a direction toward the non-releasable panel.

In operation, the frame may retain the non-releasable panel and maintain it vertically upright. The non-releasable panel may be hinged to a movable panel of the plurality along a vertical edge of the non-releasable panel. The movable panels of the plurality may be serially hinged together accordion-like.

The actuator may include a surface configured to receive the force. The actuator may include plastic. The actuator may include metal. The actuator may include any suitable material. Any suitable material may include ceramic.

The actuator may include a stem that supports the surface. The actuator may be linked to the plunger via a linkage. The linkage may include a pin disposed transverse the longitudinal axis. The pin may extend through the plunger at the second end of the plunger. The pin may extend through the stem away from the surface.

The stem may include a length disposed away from the surface. The length may be disposed athwart the second end of the plunger. The pin may extend transverse the longitudinal axis, through the length and through the second end of the plunger.

The stem may include a contour between the length and the surface. The contour may be disposed between the pin and the surface. The contour may bulge convexly in the direction of the head. The contour may be configured to interfere with an exterior facet of the body. The contour may be configured to interfere with the exterior facet of the body to progressively draw the linkage in the direction of the second end as the contour is progressively forced along the facet. The application of the force to the actuator may retract the head from the forward location. The body may be configured to receive the head as the plunger is retracted back from the forward location. The application of the force may allow the moveable panels to move past the body in a direction away from the non-releasable panel.

As the contour is progressively forced along the facet by application of the force, the actuator may swivel about the pin. As the contour is progressively forced along the facet, the surface may move toward the first end of the plunger and toward the body.

The second face of the head may be configured to receive a momentum directed transverse the longitudinal axis. The second face may include a curvilinear region configured to receive a contact force. The momentum may be received from a contact force transferred to the second face by a panel of the plurality of movable panels as that panel moves toward the non-releasable panel and the panel's leading edge encounters the head.

The second face of the head may be configured to transmit a component of the transverse momentum to the plunger. The component may be a longitudinal momentum directed toward the second end of the plunger. The momentum may drive the head in a direction opposite the spring bias. The momentum may drive the head into the body and, thereby, allow the panel to move past the body toward the non-releasable panel. After the panel moves past the body, the spring may restore the head to the forward location. After application of the contact force, the spring may restore the head to the forward location.

The locking mechanism may be affixed to the frame below knee-height of a standing user, disposing the actuator as a foot pedal configured for application of the force. The force may be applied by the user's foot.

The locking mechanism may be affixed to the frame so as to dispose the first face of the head parallel to and facing the broad side of the non-releasable panel. The mechanism may be affixed to the frame at a distance from the non-releasable panel. The distance may set a space between the first face and the broad side of the non-releasable panel. The space may accommodate a thickness of all the movable panels stacked against the broad side of the non-releasable panel.

The distance may be adjustable. The mechanism may be affixed to the frame at an adjustable distance from the non-releasable panel. Adjustment of that distance and of the space between the the first face and the broad side of the non-releasable panel may accommodate augmentation of the plurality by addition to the plurality of movable panels to be stacked and secured against the non-releasable panel. Adjustment of that distance and of the space between the first face and the broad side of the non-releasable panel may accommodate reduction of the plurality by removal of movable panels to be stacked and secured against the non-releasable panel.

The frame may include an exterior vertical wall of the system. A magnet may be disposed on the exterior wall. The magnet may be affixed to the wall. The magnet may be embedded in the wall. The magnet may project outward from the wall. The magnet may be configured to releasably adjoin the frame to a magnetic element of a component of an other expandable room divider. The magnetic component of the other expandable room divider may be an exterior wall of a frame of the other expandable room divider. The magnet may be configured to attract and releasably hold the magnetic element of the component of the other expandable room divider. The magnet may be configured to attract and releasably hold the exterior wall of the frame of the other expandable room divider.

The system may provide for selectively securing together room partitions and deploying room partitions. Securing the room partitions together may facilitate storage of the room partitions. Securing the room partitions together may facilitate transport of the system. Secured room partitions may be selectively unsecured to deploy the room partitions. The selectively unsecured room partitions may be deployed to form a room divider.

A non-releasable room partition may be affixed to the frame. Selectively, distinct configurations of the plurality of movable room partitions may be attained. The plurality of movable room partitions may be locked against the non-releasable room partition. The plurality of movable room partitions may be unlocked from the frame. The plurality of movable room partitions may be moved away from the non-releasable room partition. The plurality of movable room partitions may be deployed to form an extended room divider. The plurality of movable room partitions may be returned to the frame and secured against the non-releasable room partition.

The extended room divider may be configured by increasing a hinge-angle of one or more than one pair of adjacent hinged room partitions to a value between zero degrees (the hinge-angle value between adjacent securely stacked room partitions) and 180 degrees (the hinge-angle value of room partitions in a fully extended room divider with its room partitions forming a single-file straight line). The extended room divider may be configured with its room partitions set in an accordion-pleat configuration.

The extended room divider may be configured to form a single-file straight line. Adjacent room partitions of the room divider may be secured together in expanded form by a latching bolt or hook and a complementary latch bolt/hook recess disposed in facing narrow edges of the room partitions. The latching bolt/hook may be locked into the recess.

The extended room divider may be configured to form two sides of an enclosure with any given acute angle between the sides. The extended room divider may be configured to form two sides of enclosure with any given obtuse angle between the sides. The extended room divider may be configured to form three or more sides of an enclosure. The enclosure may feature an opening. The opening may be a gap between ends of the extended room divider. The opening may be closed by a selectively movable room partition serving as a door of the enclosure. The plurality of movable room partitions may be returned to the frame and secured against the non-releasable room partition.

When the head at the first end of the plunger is in the forward location, the head may block the movable room partitions from moving past the head in a direction away from the non-releasable room partition. The head in the forward location may prevent passage of the movable room partitions past the head in a direction away from the non-releasable room partition.

The user may apply force, as via the user's foot, to the actuator. The applied force may retract the head from the forward location. The head may be drawn back in the direction of the second end of the plunger. The head may be retracted into the body of the lock mechanism. The retracted head may not block passage of the movable room partitions past the head in a direction away from the non-releasable room partition. Retraction of the head by application of user-force to the actuator may allow the releasable room partitions to be unsecured and moved from the non-releasable room partition. Unsecuring and moving the releasable room partitions from the non-releasable room partition may facilitate deployment of the movable room partitions and of the non-releasable room partitions into a configuration of the extended room divider.

A room partition of the plurality may be equipped with wheels. The wheels may be disposed below a lower edge of the room partition, the room partition oriented vertically upright. The wheels may be disposed at opposing ends of a wheelbase. The wheelbase may be oriented transverse a plane of a broad side of the room partition.

A wheelbase of a given room partition of the plurality may be longer than a wheelbase of an other room partition of the plurality The other room partition may be closer than the given room partition in serially hinged sequence to the non-releasable room partition. The other room partition may be between the given room partition and the non-releasable room partition in serially hinged sequence. The other room partition may be between the given room partition and the non-releasable room partition in the extended room divider. The given room partition may be closer, in serially hinged sequence, to yet another room partition of the plurality. In serially hinged sequence, the given room partition may be closer to the non-releasable room partition than one or more room partitions of the plurality. In serially hinged sequence, the given room partition may be further from the non-releasable room partition than one or more room partitions of the plurality. In serially hinged sequence, the given room partition may be disposed in the extended room divider at or near the center of the extended room divider. The longer wheelbase may confer vertical stability on the given room partition. The longer wheelbase may confer vertical stability on the extended room divider.

The locking mechanism may be affixed adjustably to the frame. The frame may feature several sets of affixing sites for the mechanism. Each affixing site may be disposed on the frame to space the head to accommodate a specific number of movable room partitions between the head and the non-releasable room partition. An affixing site may present one or more screw holes along the frame. The screw holes may be tapped screw holes. The mechanism may be affixed to an affixing site by screws or bolts running through the screw holes. Each affixing site may be disposed on the frame to space the head so as to secure the specific number of the system's movable room partitions between the head and the non-releasable room partition.

The number of movable room partitions may be adjusted by unhinging adjoining room partitions of the plurality and then selectively: a) Removing one or more pairs from the plurality and hinging together the remaining pairs; or b) adding one or more pairs of hinged movable room partitions to the plurality, incorporating the one or more pairs into the plurality by hinging edges of the one or more pairs to unhinged edges of the plurality. Hinges along edges of specific room partitions may be configured for user-adjustment of the number of movable room partitions.

The system may be a first system. The frame may be a first frame. The non-releasable panel may be a first non-releasable panel. The locking mechanism may be a first locking mechanism. A second system may include a second frame retaining a second non-releasable panel, the second frame, in operation, retaining the second non-releasable panel and maintaining it vertically upright. The second non-releasable panel may be hinged along a non-retained vertical edge of the second non-releasable panel to a panel of a second plurality of movable panels. The second system may include a second locking mechanism affixed to the second frame. The second locking mechanism may be configured to selectively prevent and allow movement of the second plurality of the movable panels away from the second frame.

The second system may be adjoined to the first system via intersystem couplers. Couplers may be integral with the frame of the first system. Couplers may be integral with the frame of the second system. Couplers may be set into the first frame. Couplers may be set into the second frame. Couplers may be fastened to the first frame. Couplers may be fastened to the second frame. The couplers may be used to couple adjoining systems of expandable room dividers. The couplers may be used to couple adjoining systems of expandable room dividers at their respective frames. The couplers may be used to couple adjoining systems of expandable room dividers at locations along the dividers different from their respective frames. The couplers may be used to couple adjoining systems of expandable room dividers at the frame of one of the systems and at a location along the dividers different from their respective frames. Couplers may include magnets. Points of coupling of adjoined systems may include magnetic material such as metal. Couplers may include any suitable coupling apparatus. Any suitable coupling apparatus may include snap fasteners. Any suitable coupling apparatus may include Velcro®.

According to an illustrative presentation of the methods for selectively securing together room partitions and deploying room partitions, method steps may include:

A) moving, sequentially to a frame, wheel-equipped vertical room partitions of a plurality of room partitions, the plurality of room partitions serially hinged together, accordion-like;

B) stacking the plurality of room partitions into a stack against an other room partition that is affixed vertically to the frame (i.e., a frame-affixed room partition), the frame-affixed room partition hinged, away from its side of affixment to the frame, to one of the plurality of room partitions, a hinge-angle between adjoining hinged partitions in the stack typically being about zero;

C) securing the stack against the frame-affixed room partition via the system locking mechanism affixed to the frame, the head of the first end of the locking mechanism plunger disposed by spring-bias in the forward location, the head thus blocking the stack from moving past the head in a direction away from the frame-affixed room partition, the head spaced from the frame-affixed room partition to accommodate the thickness of the stack;

D) selectively applying a force to the system locking mechanism actuator, the applied force countering the spring-bias and drawing the plunger in the direction of the second end of the plunger opposite the head, thus retracting the head back from the forward location;

E) sequentially moving room partitions of the plurality past the retracted head in the direction away from the frame-affixed room partition, thereby releasing the room partitions of the plurality for deployment; and F) deploying the frame-affixed room partition and the released room partitions of the plurality by increasing toward 180° adjoining room partitions' hinge-angles.

Additionally, the method step A) above of moving panels to the frame may include:

G) applying a contact force to the head in the forward position, the contact force applied via a room partition of the plurality as that room partition moves toward the frame-affixed room partition and, edgewise, encounters the head;

H) thus shifting the head back from the forward location toward the second end; and I) allowing the room partition of the plurality to move past the shifted head in the direction of the frame-affixed room partition, after which the spring may restore the head to the forward location.

System apparatus in accordance with this disclosure will now be described in connection with the figures, which form a part hereof. The figures show illustrative features of system apparatus in accordance with the principles of this disclosure. Systems described herein may be used to carry out one or more of method steps A-I presented above. It is understood that other embodiments may be utilized, and that structural, functional and procedural modifications may be made without departing from the scope and spirit of the present disclosure.

FIG. 1 shows frame 101 that may be a component of a system for deployment, storage and transport of an expandable room divider. As illustrated, frame 101 includes base beam 102. Beam 102 serves as a base for lower handrails 104, to which are connected upper handrails 106. Beam 102 and handrails 104 and 106 are connected to vertical edge cladding 108.

All or some of cladding 108, beam 102, and handrails 104 and 106 may include metal. All or some of cladding 108, beam 102, and handrails 104 and 106 may include other suitable materials. Other suitable materials may include wood. Other suitable materials may include plastics. Other suitable materials may include ceramics.

Cladding 108 may be joined to base 102. Cladding 108 may be bolted to base 102. Cladding 108 may be welded to base 102.

Lower handrails 104 may be joined to base 102. Lower handrails 104 may be bolted to base 102. Lower handrails 104 may be welded to base 102.

Upper handrails 106 may be joined to lower handrails 104. Upper handrails 106 may be bolted to lower handrails 104. Upper handrails 106 may be welded to lower handrails 104.

Handrails 104 may be joined to cladding 108. Handrails 104 may be bolted to cladding 108. Handrails 104 may be welded to cladding 108. Handrails 104 may traverse cladding 108. Handrails 104 may pass through cladding 108.

Handrails 106 may be joined to cladding 108. Handrails 106 may be bolted to cladding 108. Handrails 106 may be welded to cladding 108. Handrails 106 may traverse cladding 108. Handrails 106 may pass through cladding 108.

Anticipated also are other configurations (not shown) of frame 101's base 102, cladding 108, and handrails 104 and 106. Such other configurations may lend stability to the cladding. Such other configurations may contribute to ease of manipulation of the frame. Such other configurations may feature handrails of geometry different from that shown. Such geometries may feature curvatures and/or relative lengths different from that shown. Such other configurations may feature fewer or more connections than illustrated between the handrails and the cladding. Such other configurations may feature one or more handgrips strategically located along the handrails and/or the cladding.

Figure 2:
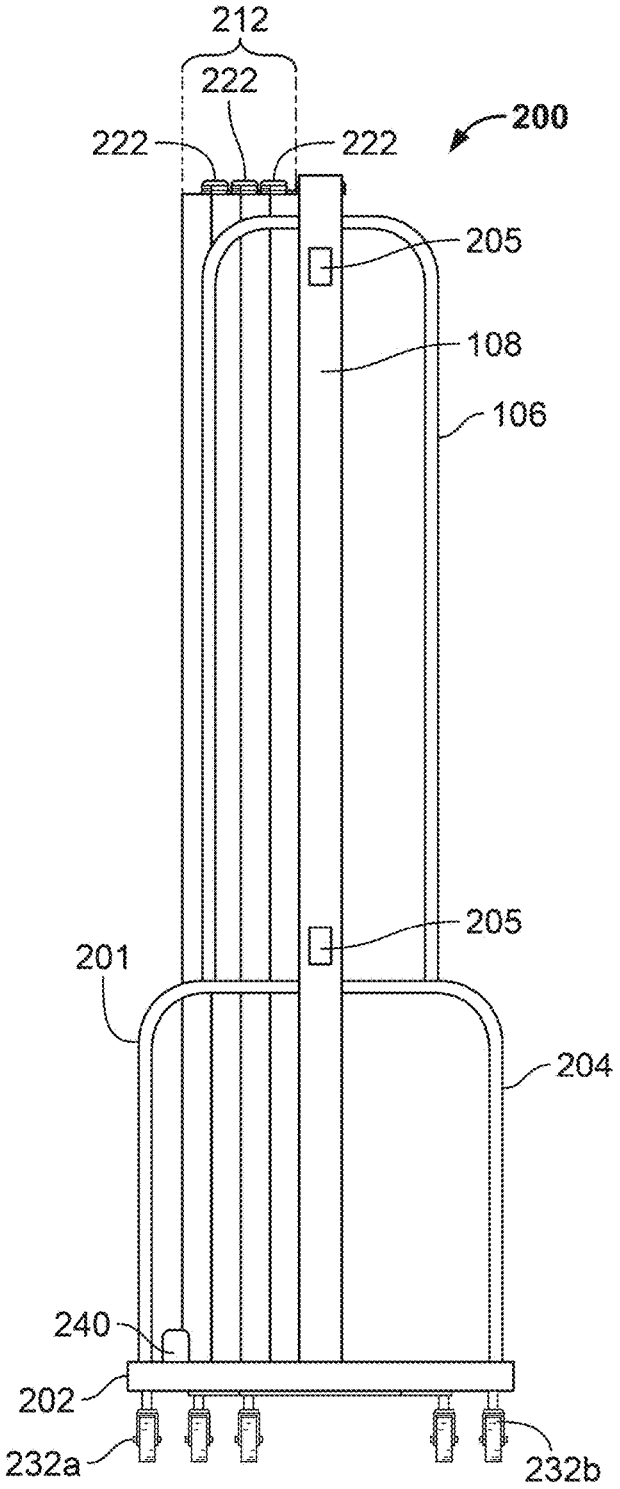
FIG. 2 shows the frame of FIG. 1 as it might appear together with panels in a system in accordance with principles of the invention.

FIG. 2 shows a system 200 for deployment, storage and transport of an expandable room divider. System 200 is illustrated as including frame 201 with base beam 202, and with vertical edge cladding 108 and lower handrails 204 joined to beam 202. Lower handrails 204 may be joined to cladding 108. Upper handrails 106 may be connected to lower handrails 204. Upper handrails 106 may be joined to cladding 108. Beam 202 may be equipped with wheels 232*a* and 232*b*. Wheels 232*a* and 232*b* may be lockable. Wheels 232*a* and 232*b* may be mounted to beam 202. Wheels 232*a* and 232*b* may be mounted to beam 202 at locations along beam 202 that, in operation of system 200, confer stability upon system 200.

System 200 may include locking mechanism 240. Mechanism 240 may restrain plurality 212 of panels from moving from frame 201. Mechanism 240 may be connected to beam 202. Mechanism 240 may be connected to beam 202, spaced from cladding 108 so as to accommodate plurality 212. Mechanism 240 may be adjustably connected to beam 202. Mechanism 240 may be adjustably connected to beam 202 to facilitate use of a plurality of panels that includes fewer/more and/or thinner/thicker panels than those illustrated.

Frame 201 is shown with intersystem couplers 205. Couplers 205 may be integral with cladding 108. Couplers 205 may be set into cladding 108. Couplers 205 may be fastened to cladding 108. Couplers 205 may be used to couple adjoining systems of expandable room dividers. Couplers 205 may be used to couple adjoining systems of expandable room dividers at their respective frames, such as that illustrated by frame 201. Couplers 205 may be include snap fasteners. Couplers 205 may be include Velcro®. Couplers 205 may be include magnets. Points of coupling of adjoined systems to couplers 205 may include magnetic material such as metal.

The panels of plurality 212 may be feature hinges along vertical edges. The panels may be serially hinged together at adjacent vertical edges. The hinges may feature hinge caps 222.

Figure 3:
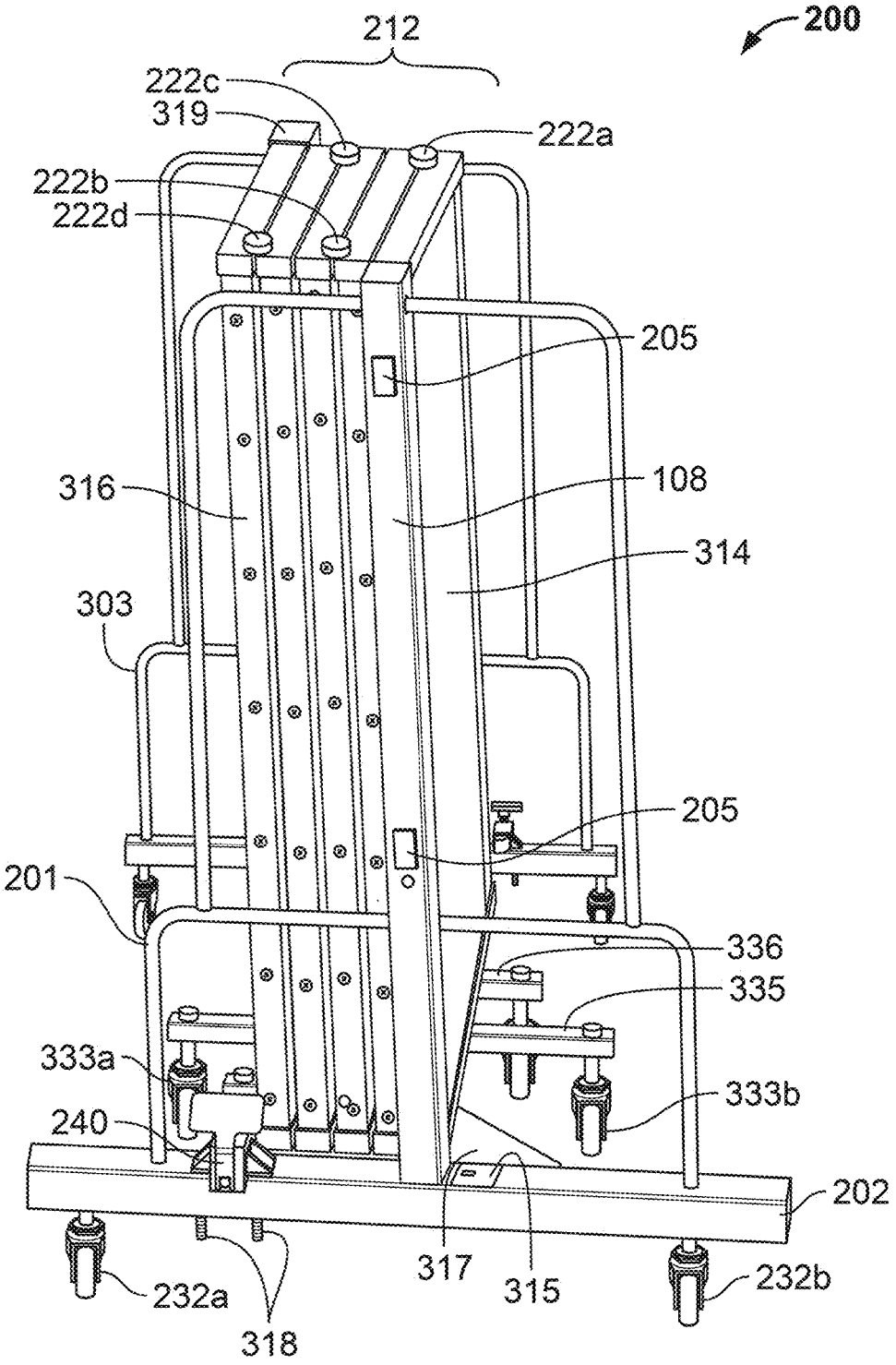
FIG. 3 shows a perspective view of the frame and panels of the system of FIG. 2.

FIG. 3's perspective view of system 200 shows frame 201, with base 202 connected to cladding 108. Cladding 108 is shown featuring intersystem couplers 205. Wheels 232*a* and 232*b* are shown connected to base 202. Locking mechanism 240 is shown affixed to base 202 by screws 318 traversing beam 202. Other suitable mechanical means (not shown) of affixing locking mechanism 240 to base 202 are anticipated. Other suitable mechanical means of affixing locking mechanism 240 to base 202 include lockable complementary contours of convexities and concavities on an upper surface of beam 202 and on a bottom surface of locking mechanism 240.

FIG. 3's perspective view of system 200 shows hinge caps 222 at the top of the plurality 212 of panels (hinge caps 222 shown in FIG. 2) as hinge caps 222*a*, 222*b*, 222*c* and 222*d* alternating between the foreground and background of plurality 212 of panels that are serially hinged on vertical adjacent edges, accordion-like, together. Panel 314 is shown as a non-releasable panel held vertically upright and clad by cladding 108, with panel 314 hinged along a far vertical edge to an adjacent panel of plurality 212 by hinges (not visible in the view of FIG. 3) capped by hinge cap 222*a*.

Panel 314 and the panels of plurality 212 may be metal edge-enclosed, with metal edge-enclosures wrapped about some or all four narrow edges of each panel. Panel 314 may be further maintained perpendicular to frame 201 by perpendicularity stabilizer 317 affixed to the bottom of panel 314, typically to a horizontal bottom edge-enclosure of panel 314. Perpendicularity stabilizer 317 is shown fastened to base 202 via stabilizer tab 315.

The plurality 212 of panels is shown equipped with wheels mounted to wheelbases. Wheels 333*a* and 333*b* are mounted to wheelbase 335 running transverse to plurality 212. Wheelbase 336 is shown running transverse to plurality 212.

Furthest in hinged serial sequence from panel 314 is panel 316, with a vertical foreground edge-enclosure facing forward. Panel 316 is retained and maintained vertically upright by vertical cladding 319 that is a component of frame 303.

Figure 4:
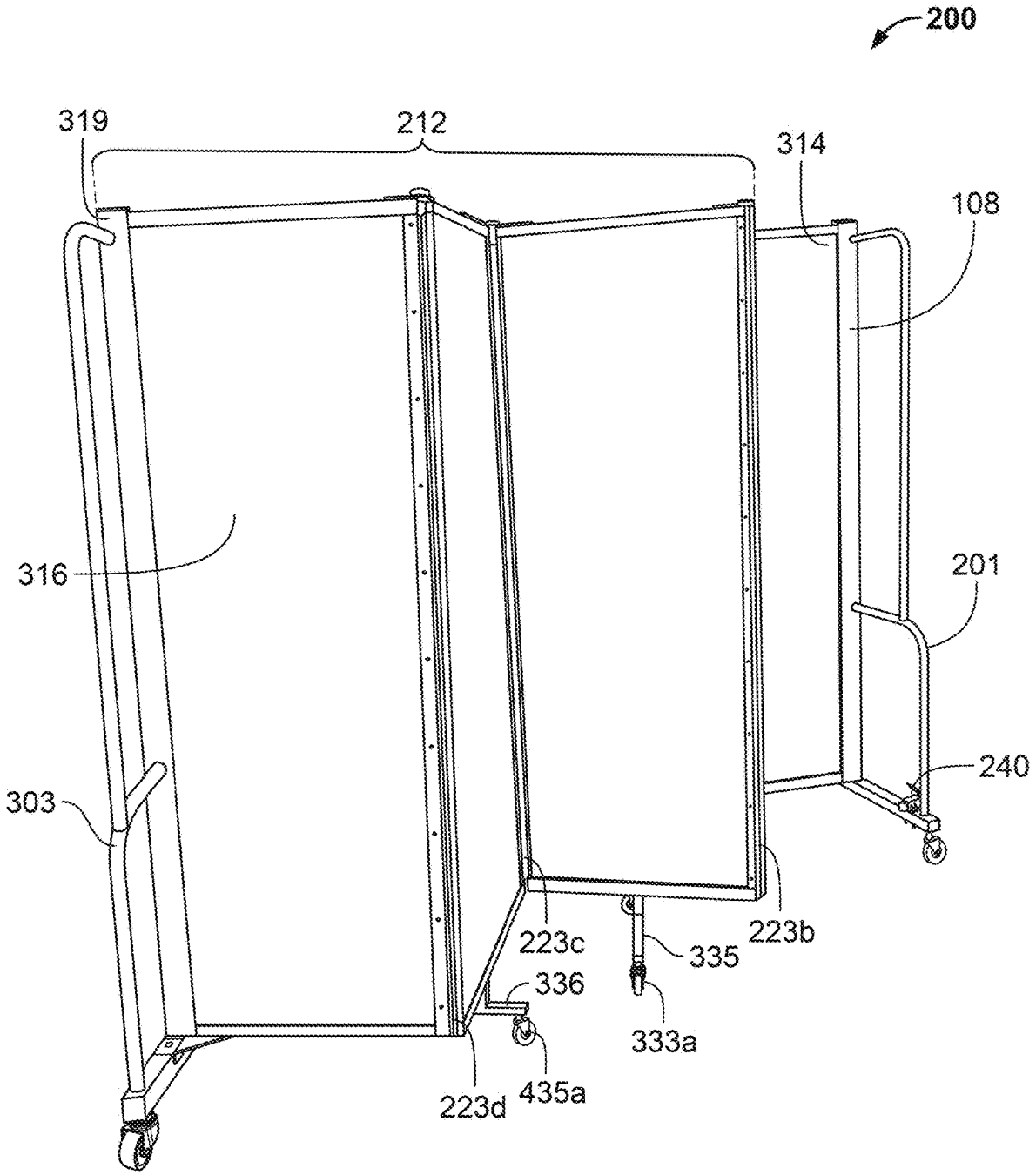
FIG. 4 shows the frame and panels of the system of FIG. 3 in an expanded configuration in accordance with principles of the invention.

FIG. 4 shows system 200 is a configuration of deployment, with plurality 212 of panels no longer restrained in a stack against panel 314 (contrary to what had been the case depicted in FIGS. 2 and 3). Rather, each of plurality 212 of panels has been moved past locking mechanism 240 away from panel 314, which is not movable/releasable from frame 201 since it is retained by cladding 108. Movement of plurality 212 of panels away from frame 201 is facilitated by wheels of plurality 212 of panels, such as wheel 333*a* mounted on wheelbase 335 and wheel 435*a* mounted on wheelbase 336.

Furthest in serial sequence from panel 314 is panel 316, with its most distant vertical edge (in serial sequence from panel 314) clad by cladding 319 of frame 303.

Hinge angles of hinges 223*a* (not visible in FIG. 4), 223*b*, 223*c* and 223*d* have been increased from about zero degrees in FIGS. 2 and 3.

Figure 5:
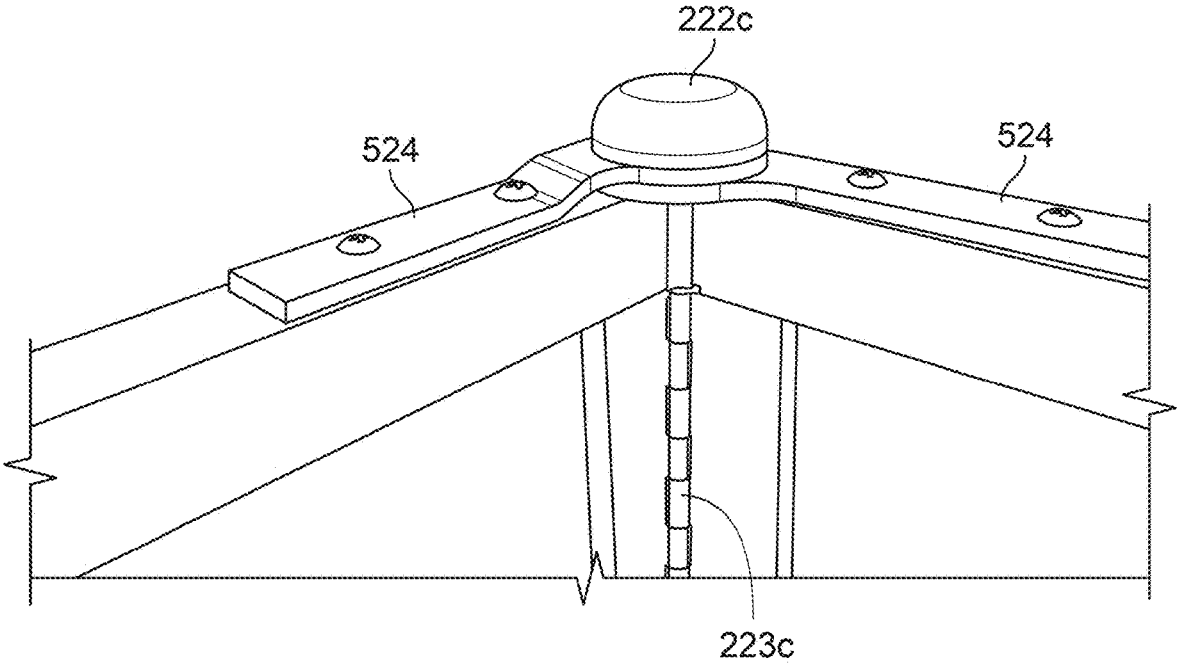
FIG. 5 shows a detail of the configuration shown in FIG. 4.

FIG. 5 shows a perspective view from above of a section of FIG. 4. FIG. 5 shows hinge cap 222*c* with hinge arms 524 extending from under hinge cap 222*c*. Hinge arms 524 are shown fastened to tops of panels of plurality 212 (shown in FIG. 4). Hinge arms 524 may be fastened into horizontal top edge-enclosures of the panels.

Figure 6:
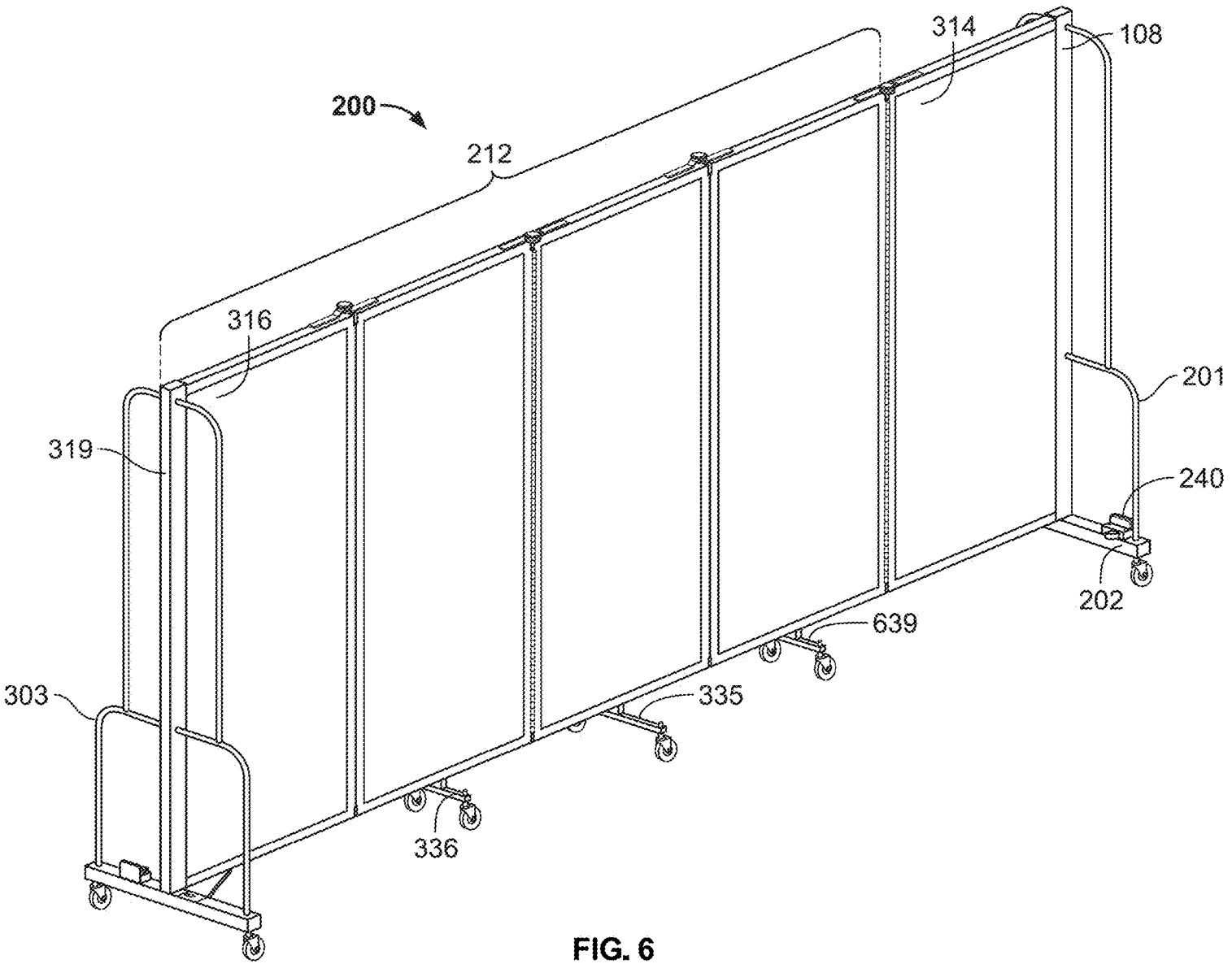
FIG. 6 shows the frame and panels of the system of FIG. 3 in another expanded configuration in accordance with principles of the invention.

FIG. 6 shows system 200 in a configuration of deployment, with plurality 212 of panels extended out from and in line with panel 314 as a fully expanded five-panel room divider. At one end of the room divider of system 200 is frame 201, with its vertical cladding 108 retaining panel 314 and maintaining it vertically upright, and with its base 202 bearing locking mechanism 240 that is not restraining any of plurality 212 of panels against panel 314.

At the other end of the fully expanded five-panel room divider of system 200 is frame 303, with its vertical cladding 319 retaining panel 316 and maintaining it vertically upright Cladding 108 maintaining panel 314 vertically upright contributes to vertical stability of the fully expanded five-panel room divider of system 200, as does cladding 319 maintaining panel 316 vertically upright. Wheelbase 335 being longer than wheelbases 336 and 639 contributes to vertical stability of the fully expanded five-panel room divider of system 200.

Figure 7:
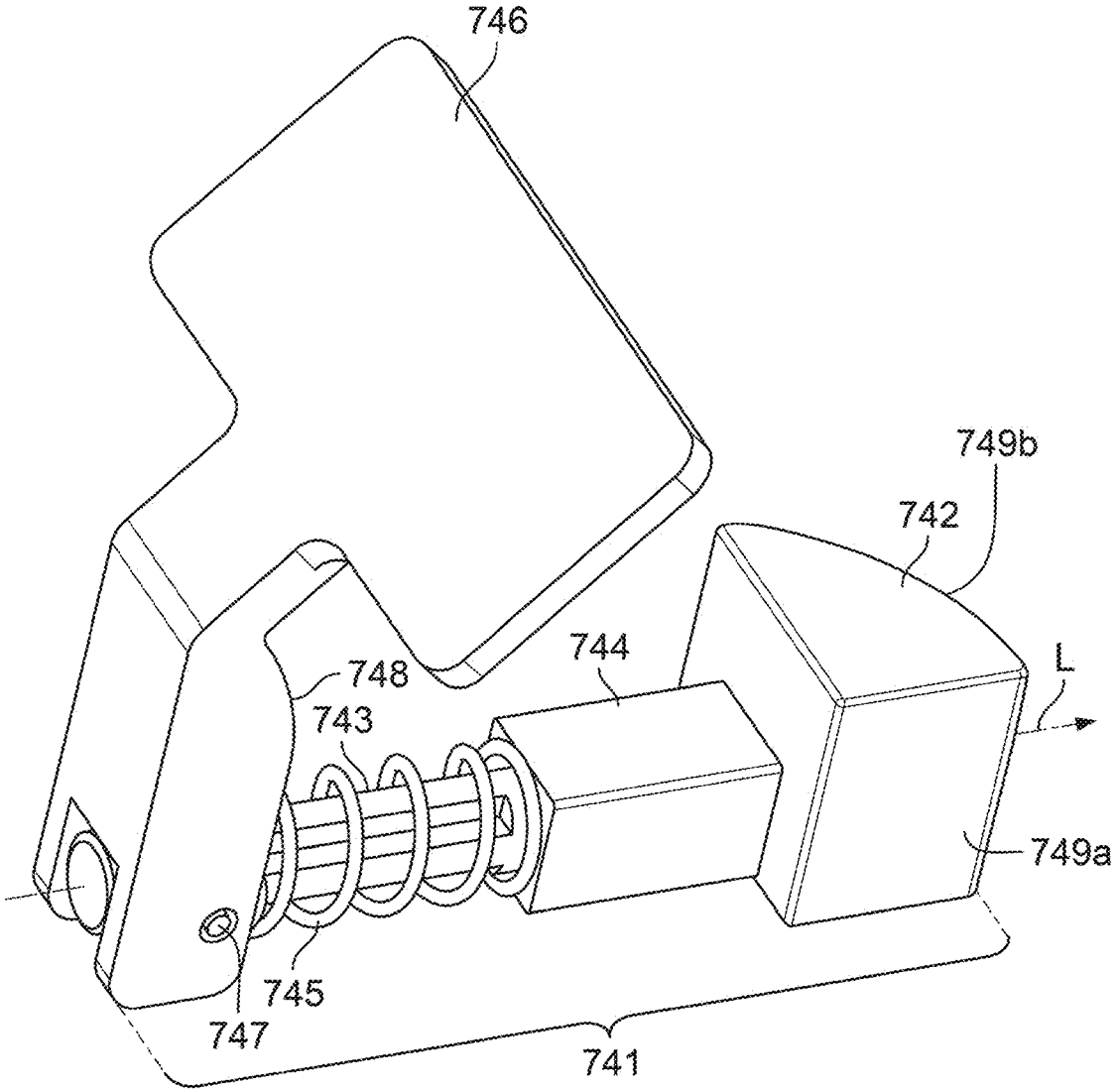
FIG. 7 shows components of a mechanism in accordance with principles of the invention.

FIG. 7 shows several components of a locking mechanism. The mechanism has a longitudinal axis L. The mechanism components include plunger 741. Plunger 741 includes posterior section 743. Plunger 741 includes medial section 744. Plunger 741 includes anterior section 742. Anterior section 742 may serve as a head of the plunger. The head has face 749*a*. Obverse face 749*a*, the head has face 749*b*. Face 749*a* may be flat. Face 749*b* may be curvilinear.

Plunger 741 is attached via pin 747 to actuator 746. Pin 747 may traverse actuator 746. Pin 747 may traverse actuator 746 transverse axis L. Pin 747 may traverse posterior section 743. Pin 747 may traverse posterior section 743 transverse axis L. Actuator 746 may swivel, at least partially if not completely, around pin 747. Actuator 746 includes contour 748 bulging convexly in the direction of anterior section 742.

The mechanism components include spring 745. Spring 745 may surround posterior section 743. Spring 745 may surround posterior section 743 anterior to pin 747 and posterior to medial section 744.

Figure 8:
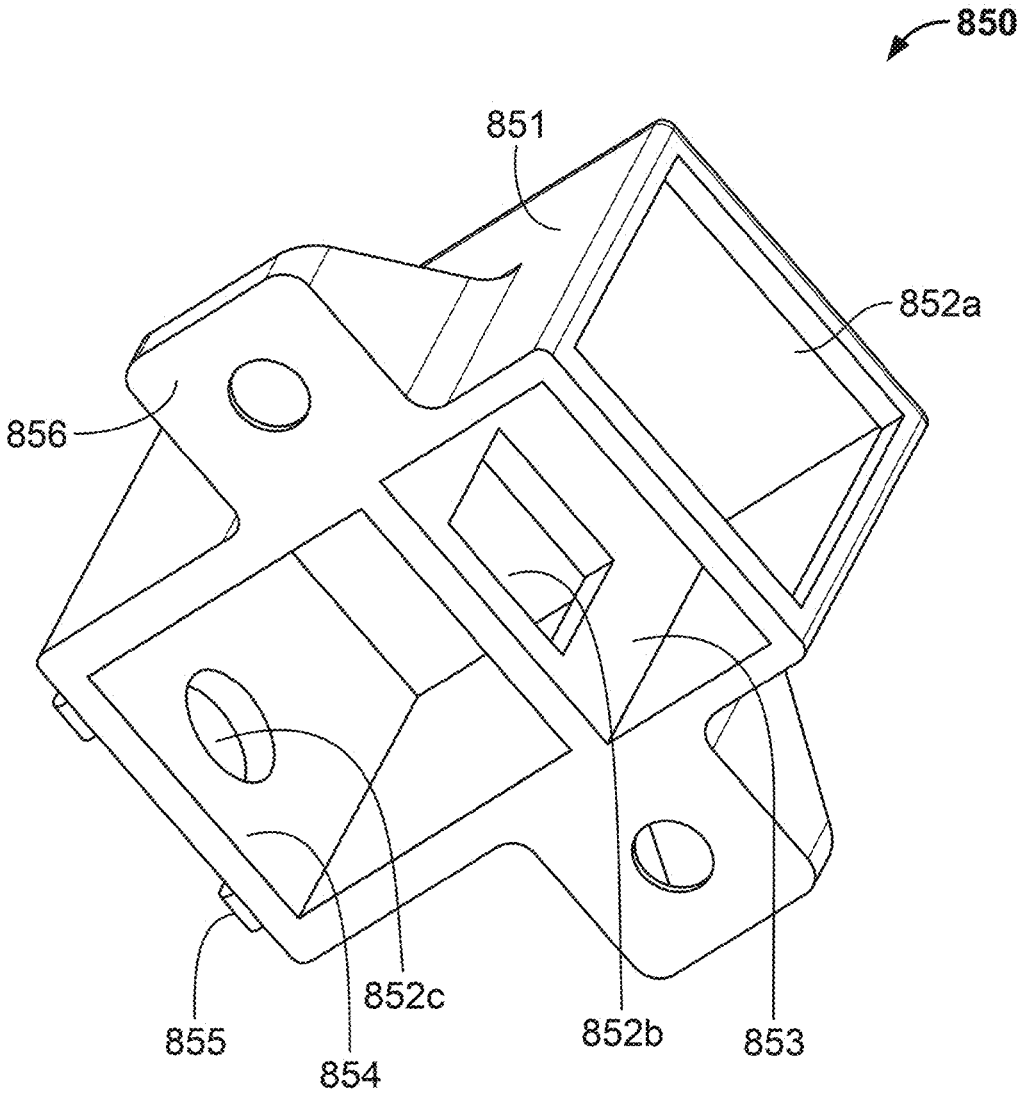
FIG. 8 shows another component of the mechanism.

FIG. 8 shows locking mechanism housing 850. Housing 850 may include exterior wall 851. Exterior wall 851 may support affixing flange 856. Housing 850 may feature anterior passageway 852*a*. Housing 850 may include medial wall 853. Medial wall 853 may feature medial passageway 852*b*. Housing 850 may include posterior wall 854. Posterior wall 854 may feature passageway 852*c*. Posterior wall 854 may support actuator guide 855.

Figure 9:
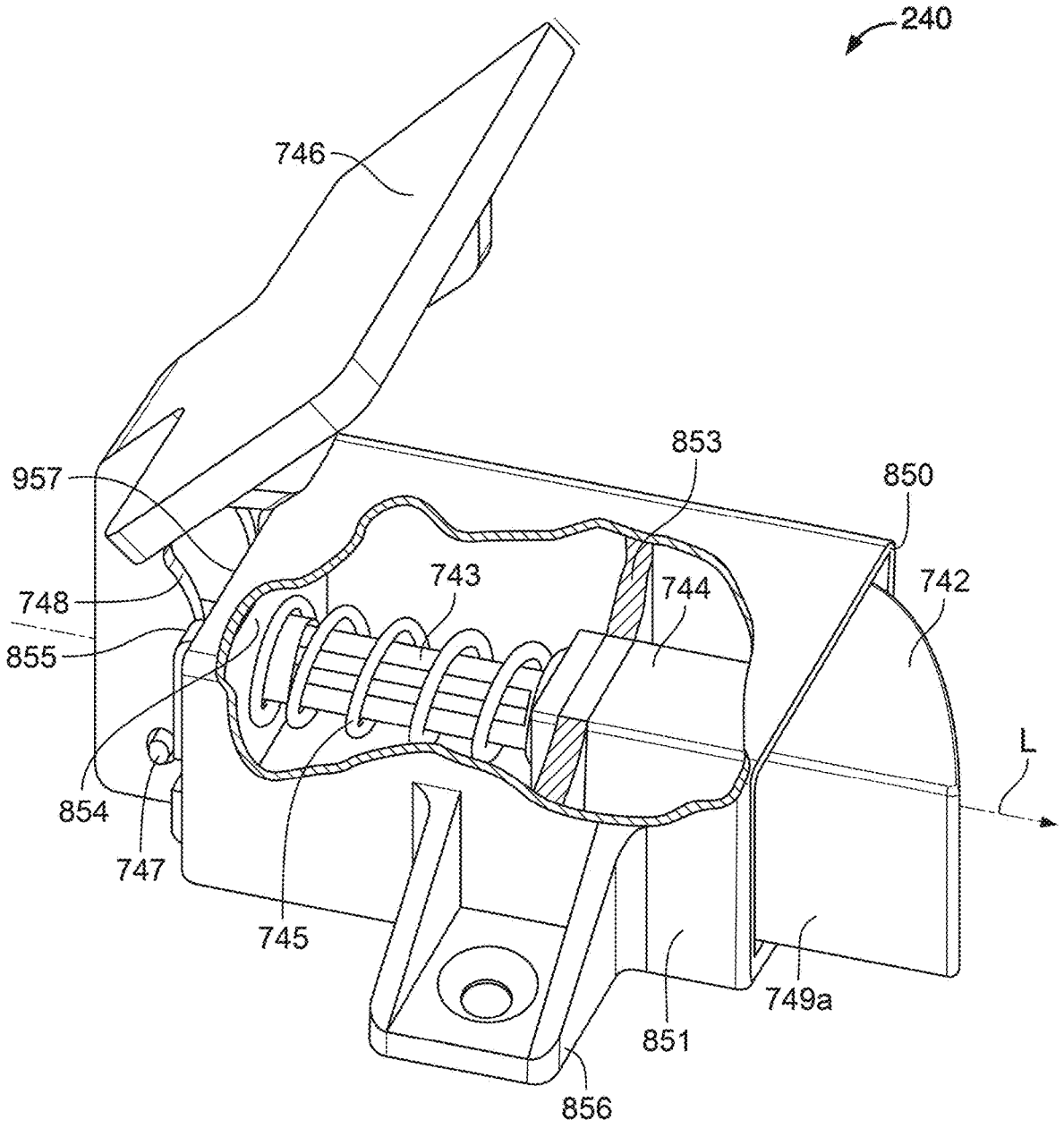
FIG. 9 shows the components of FIG. 7 together with the component of FIG. 8, with a breakaway of the FIG. 8 component providing an internal view.

FIG. 9 shows locking mechanism 240. FIG. 9 shows locking mechanism components of FIG. 7 integrated with locking mechanism housing 850. Spring 745 is shown compressed between an interior surface of posterior wall 854 and a posterior aspect of medial section 744. Medial section 744 longitudinally traverses medial wall 853. Spring 745 may bias plunger 741 forward in the direction of anterior section 742. Spring 745 may set the head into a forward location protruding longitudinally out of locking mechanism housing 850.

Actuator 746 and pin 747 remain posteriorly exterior to housing 850. Contour 748 is constrained from shifting laterally by guide 855. Contour 748 may move along exterior facet 957 of posterior wall 854. Operationally, movement downward of actuator 746's broad upper surface slides contour 748 against facet 957, swiveling actuator 746 around pin 747 and drawing posterior section 743 posteriorly out of housing 850.

Figure 10:
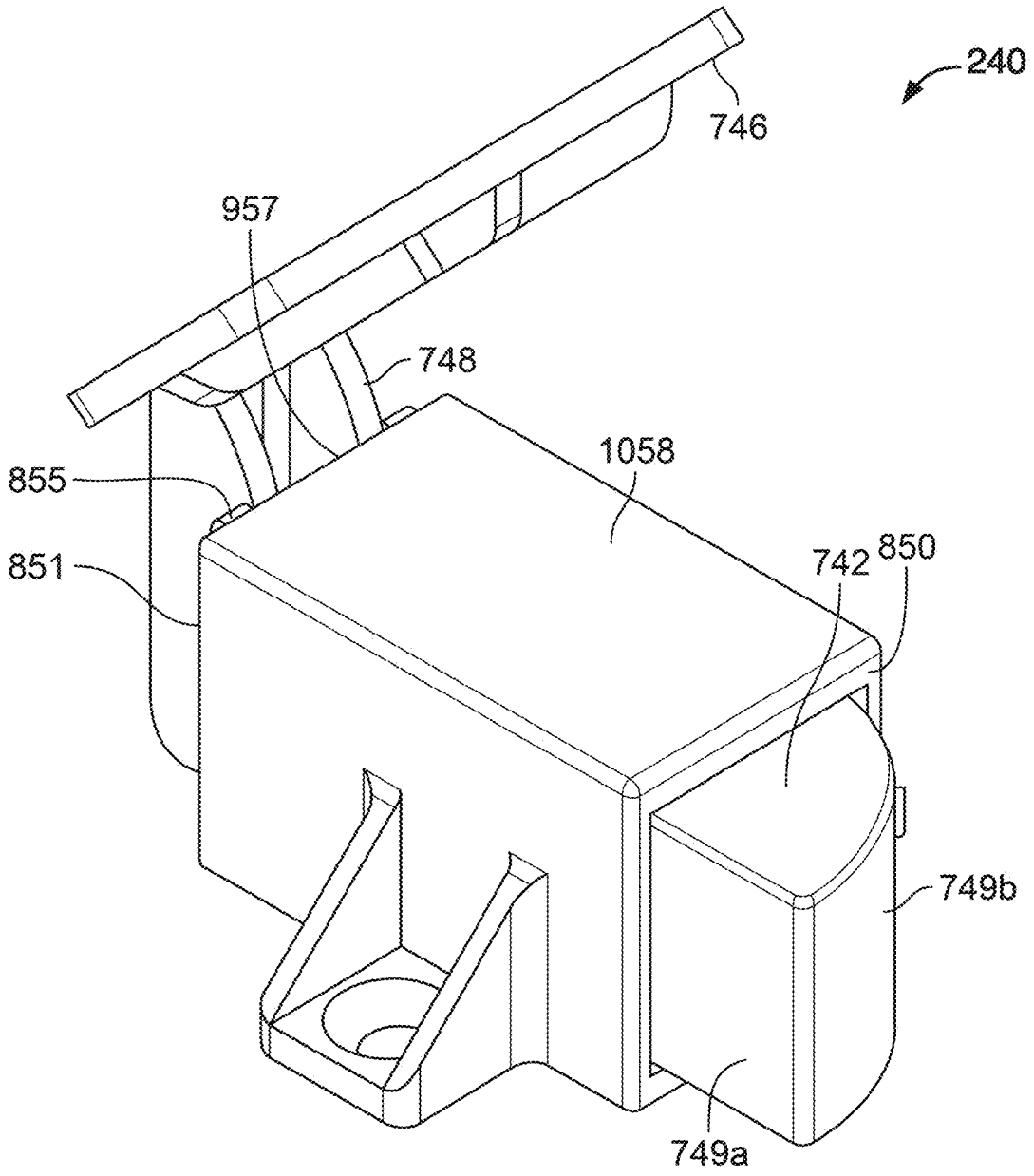
FIG. 10 shows another view of the mechanism of integrated components of FIG. 9.

FIG. 10 shows locking mechanism 240 with its upper exterior wall 1058.

FIG. 10 shows anterior section 742's head in its spring-biased forward location protruding anteriorly out of locking mechanism housing 850. FIG. 10 provides views of flat face 749*a* and of curved face 749*b*.

Figure 11:
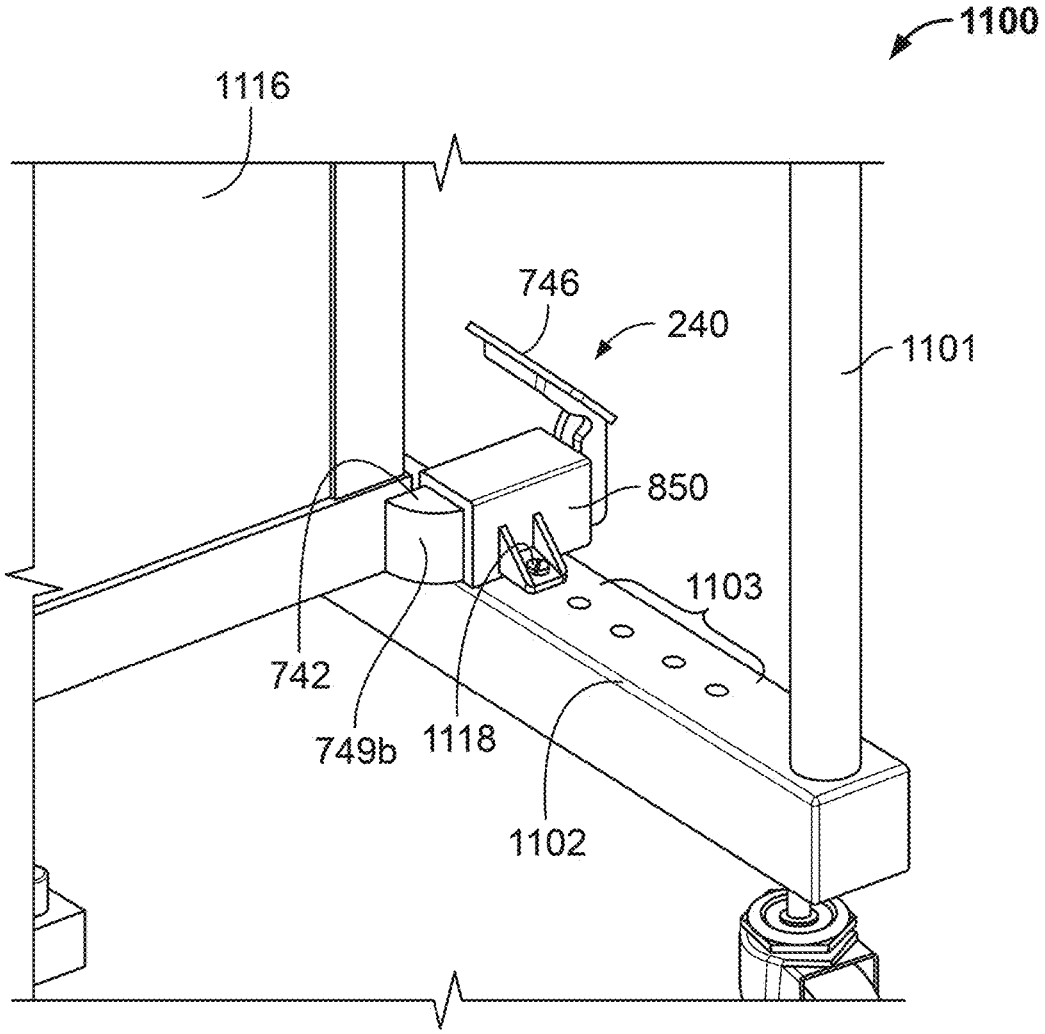
FIG. 11 shows the mechanism of FIG. 10 affixed to a frame in a system in accordance with principles of the invention.

FIG. 11 shows system 1100 for deployment, storage and transport of an expandable room divider. FIG. 11 shows locking mechanism 240 affixed to base 1102 of frame 1101. Locking mechanism 240 may be affixed to base 1102 via screws 1118 set through holes similar to holes 1103. Holes 1103 may offer alternate sites for affixing locking mechanism 240 to frame 1101. The site shown in FIG. 11 of locking mechanism 240's affixment to base 1102 situates anterior section 742's head to restrain panel 1116 from moving past the head in the direction of face 749*b*.

Figure 12:
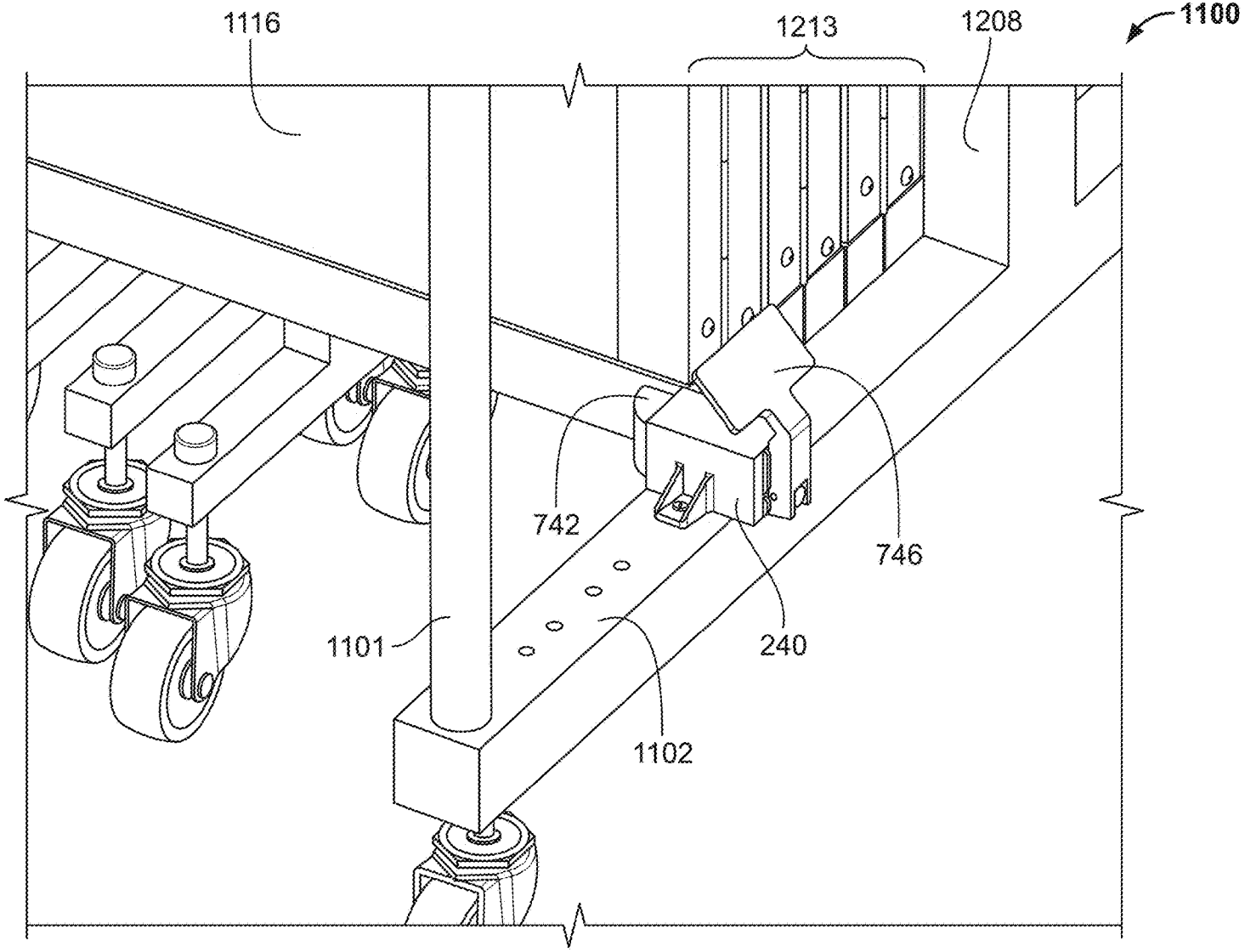
FIG. 12 shows another view of the mechanism of FIG. 10 affixed to the frame in the system.

FIG. 12 shows panel 1116 to be one of six panels of plurality 1213 of system 1100. Frame 1101's cladding 1208 retains and vertically maintains a non-releasable panel (not seen) against which plurality 1213 of panels stack, with panel 1116 being the furthest of plurality 1213 in hinged serial sequence from the non-releasable panel retained by cladding 1208.

With locking mechanism 240 situated along base 1102 to accommodate plurality 1213 and with actuator 746 in its upper position, anterior section 742's head is in its spring-loaded forward location preventing panel-movement away from frame 1101

Figure 13:
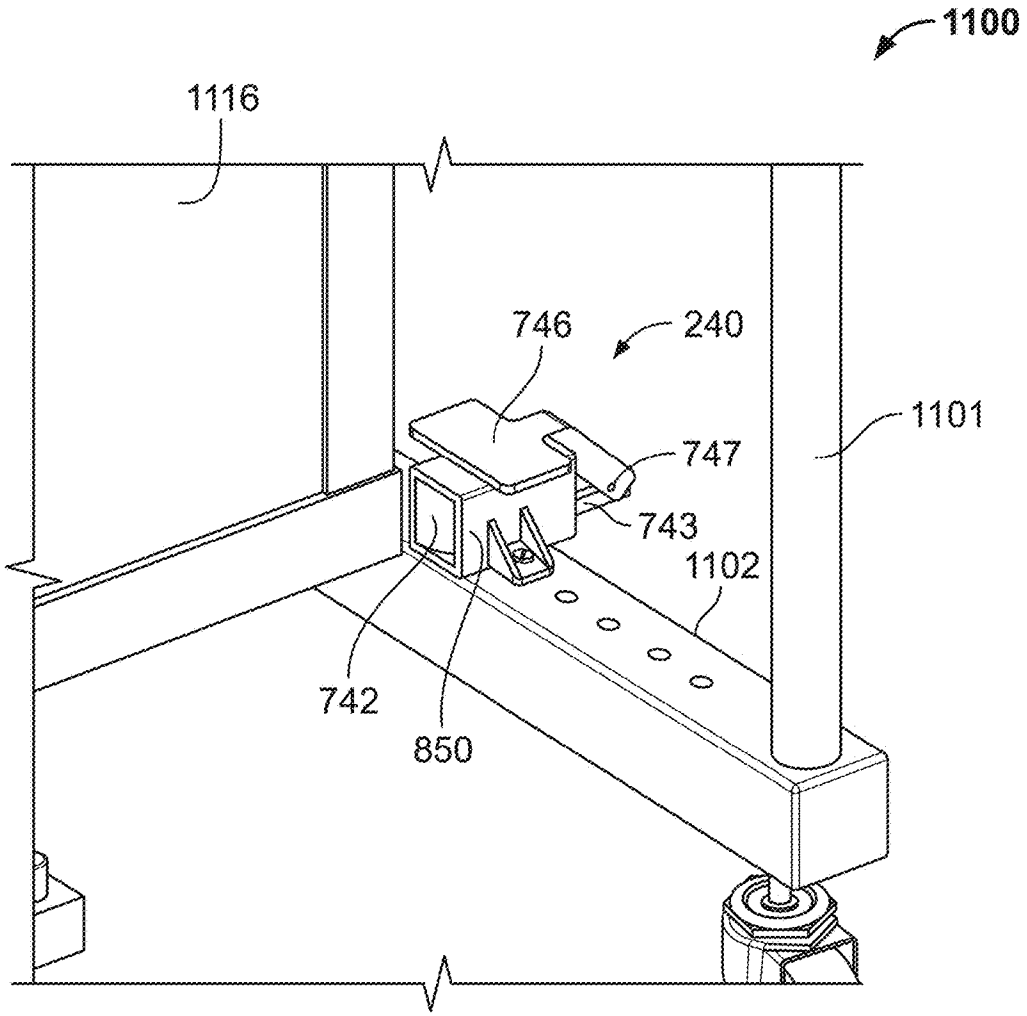
FIG. 13 shows another view of the system of FIG. 12, with components of the mechanism arranged differently from the arrangement shown in FIG. 12.

FIG. 13 shows actuator 746 of locking mechanism 240 in its lower position (such as upon receiving a user-delivered force pushing actuator 746 down), with pin 747 and posterior section 743 drawn posteriorly out from locking mechanism housing 850. Anterior section 742's head is shown retracted into locking mechanism housing 850, allowing movement of panel 1116 past locking mechanism 240 away from frame 1101.

Figure 14:
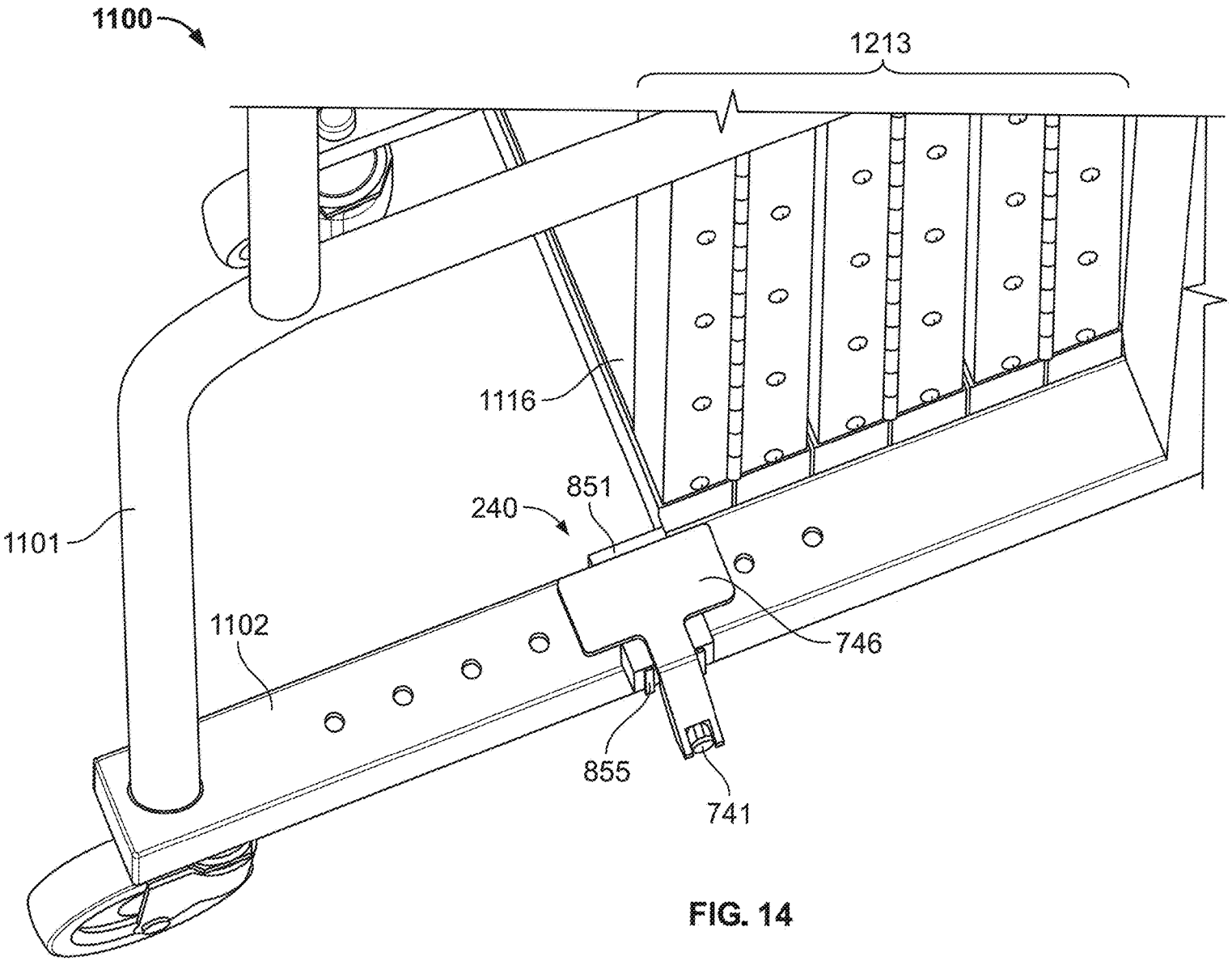
FIG. 14 shows another view of the system shown in FIG. 13.

FIG. 14 provides another view of system 1100 with actuator 746 in the lower position, with plunger 741 retracted posteriorly and plurality 1213 of panels no longer blocked from moving past locking mechanism 240; i.e., a view of the panels not being restrained from moving to the viewer's left, past locking mechanism 240's exterior housing wall 851.

Figure 15:
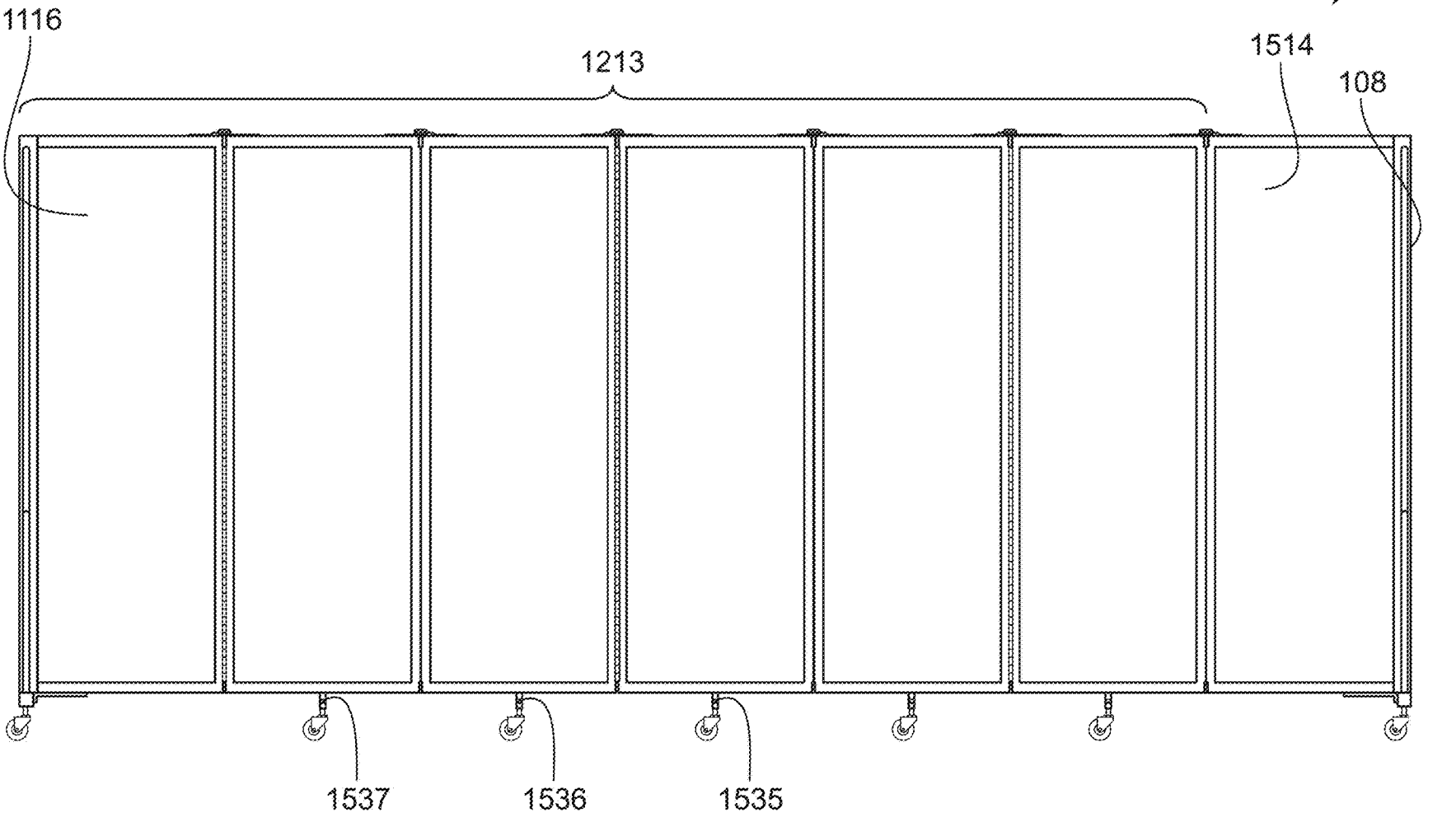
FIG. 15 shows the frame and panels of the system of FIG. 14 in an expanded configuration in accordance with principles of the invention.

FIG. 15 shows system 1100 in a configuration of deployment, with plurality 1213 of panels extended out from and in line with panel 1514 as a fully expanded seven-panel room divider. At one end of the room divider of system 1100 is panel 1514 clad by cladding 108. At the other end of the fully expanded seven-panel room divider of system 1100 is panel 1116. Movement of plurality 1213 of panels away from their having been stacked against panel 1514 is facilitated by wheels of plurality 1213 of panels, such as wheels mounted on wheelbases 1535, 1536 and 1537.

Figure 16:
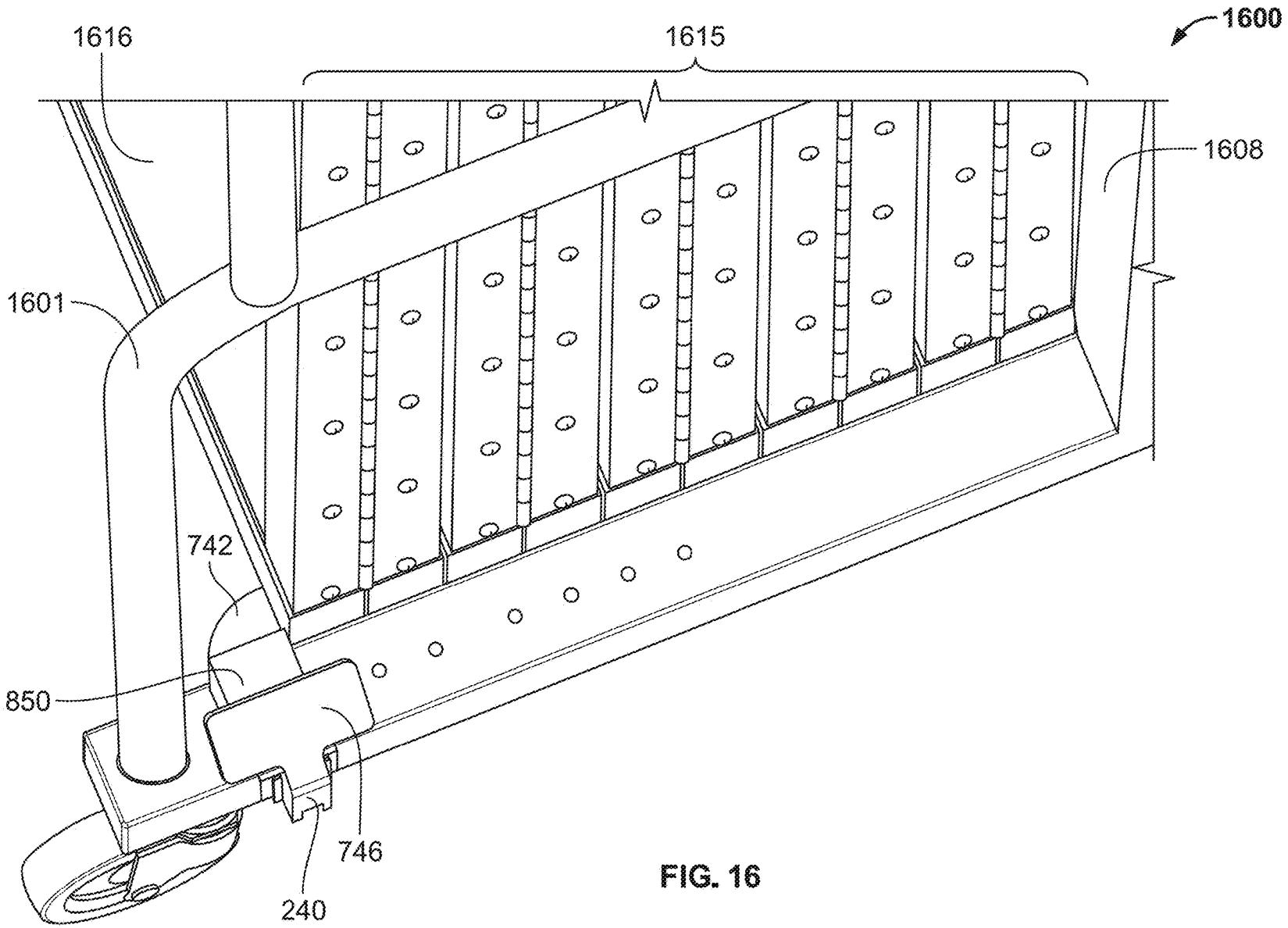
FIG. 16 shows the mechanism of FIG. 10 affixed to a frame in a system in accordance with principles of the invention.

FIG. 16 shows system 1600 for deployment, storage and transport of an expandable room divider. FIG. 16 shows locking mechanism 240 affixed to frame 1601. Anterior section 742's head, in its spring-loaded forward location protruding anteriorly out of locking mechanism housing 850, is shown restraining panel 1616 of plurality 1615 of panels from moving past the head in a direction away from cladding 1608. Locking mechanism 240 may be situated on and affixed to frame 1601 to accommodate and restrain plurality 1615 of panels in a stack against a non-releasable panel (not seen) retained and clad by cladding 1608.

Plurality 1615 is shown with ten panels. Plurality 1615 of panels may be produced by adding panels to plurality 1213 (shown in FIG. 12). Plurality 1213 of panels may be produced by removing panels from plurality 1615. Plurality 1615 of panels may be produced by adding panels to plurality 212 (shown in FIG. 3). Plurality 212 of panels may be produced by removing panels from plurality 1615. Plurality 1213 of panels may be produced by adding panels to plurality 212. Plurality 212 of panels may be produced by removing panels from plurality 1213.

Figure 17:
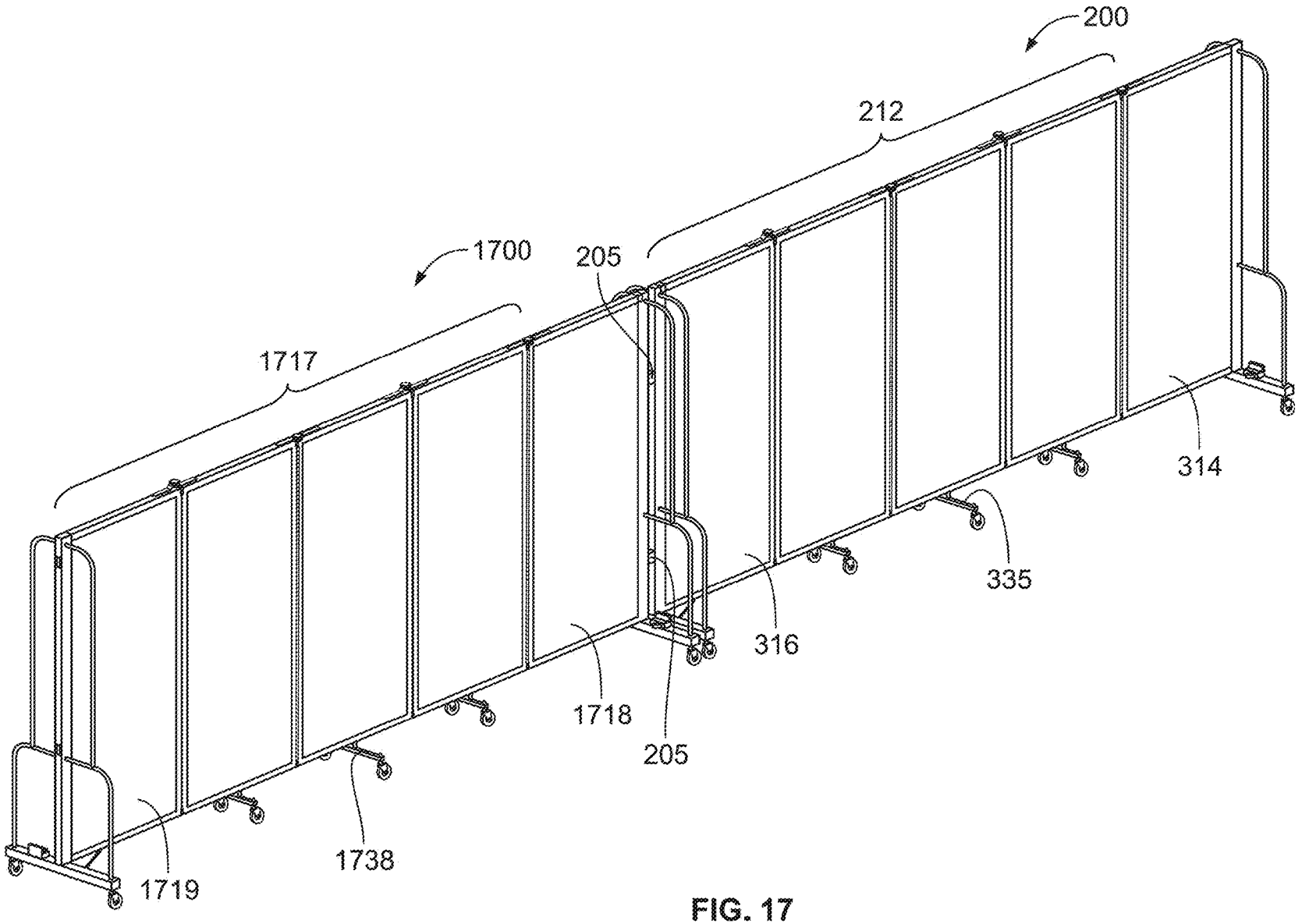
FIG. 17 shows a system similar to that shown in FIG. 6, adjoined to another such system, in accordance with the principles of the invention, as it might appear being applied to divide a space too large to be adequately divided by a single system.

FIG. 17 shows adjoining room divider systems, system 200 and system 1700. Each of system 200 and system 1700 for deployment, storage and transport of an expandable room divider, is shown in fully expanded configuration. Adjoined system 1700 and system 200 are shown coupled by intersystem couplers 205.

System 1700 includes non-releasable panel 1718. System 1700 includes plurality 1717 of panels. Plurality 1717 of panels includes panel 1719. In system 1700, panel 1719 is furthest in hinged serial sequence from panel 1718. The middle panel of system 1700 is shown with wide wheelbase 1738.

In FIG. 17, both systems depicted are five-panel room dividers. Not shown but anticipated, are adjoined systems of other and/or different numbers of panels. Not shown but anticipated, are adjoined systems of more than two systems.

In FIG. 17, the two systems are fully expanded and adjoined end-to-end to form a linear room divider. Not shown but anticipated, are adjoined systems of more than two systems. Not shown but anticipated, are adjoined systems in which one or more than one system is not fully expanded. Not shown but anticipated, are systems adjoined in non-linear configurations, where, for example, one system's frame is adjoined perpendicularly to a broad side of another system's panel.

Figure 18:
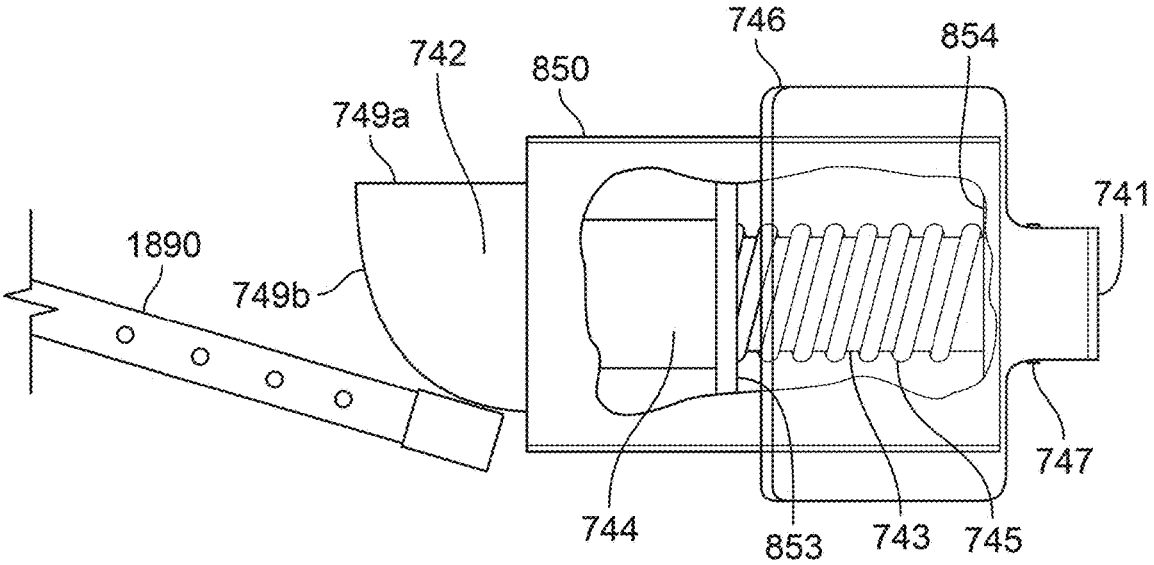
FIG. 18 shows components of the mechanism of FIG. 10, the mechanism operating in conjunction with a panel of a system in accordance with principles of the invention.
Figure 19:
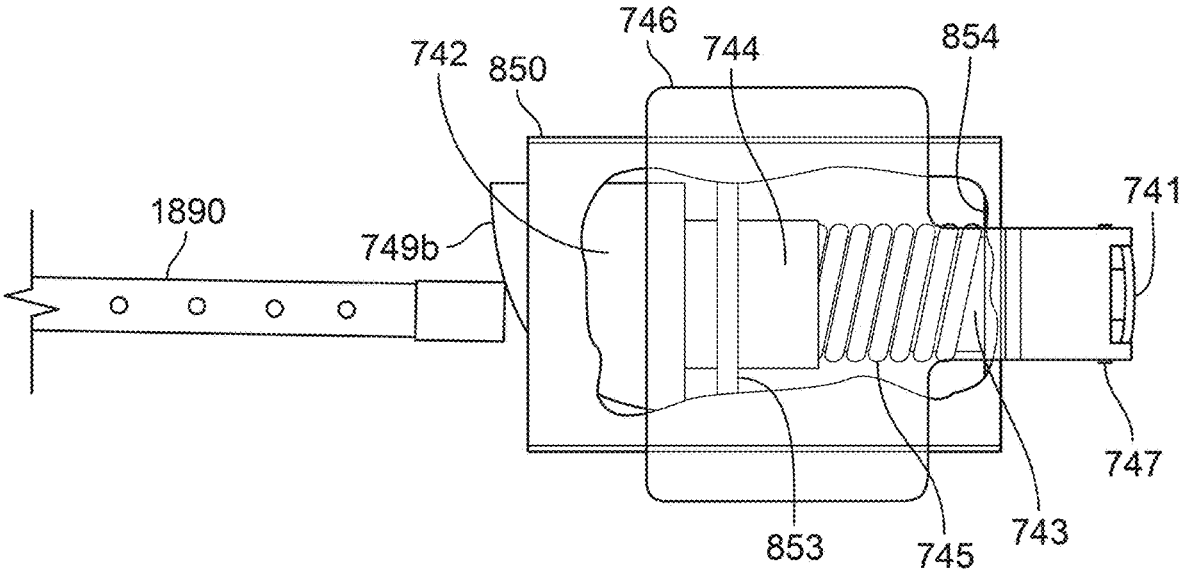
FIG. 19 shows another view of the components of the mechanism shown in FIG. 18 operating in conjunction with the panel.

FIGS. 18 and 19 depict, in a schematic view from above, stages of interaction of illustrative movable panel 1890 with components of locking mechanism 240 (shown in FIG. 9) as panel 1890 progressively moves along face 749*b* in the direction of face 749*a*.

In FIG. 18, a leading edge of panel 1890 is first encountering curvilinear face 749*b*, with anterior section 742's head in its spring-745-biased forward location and with actuator 746 in its upper position. A force of encounter between panel 1890 and anterior section 742's head has a component directed toward the posterior of plunger 741. That component is sufficient to partly counter spring 745's bias, and momentum is transferred to plunger 741 toward posterior section 743.

In FIG. 19, panel 1890 has continued its travel along curvilinear face 749*b*, with increasing posteriorly-directed momentum transfer driving anterior section 742's head progressively into housing 850; driving medial section posteriorly through medial wall 853's passageway 852*b* (shown in FIG. 8); and driving posterior section 743 posteriorly out through wall 854's passageway 852*c* (shown in FIG. 8). Retraction of plunger 741 has carried pin 747 posteriorly further from housing 850 than pin 747 had been in FIG. 18. With pin 747 shifted posteriorly, actuator 746 is shown in a lower position than in FIG. 18.

After FIG. 19's stage of interaction of panel 1890 with curvilinear face 749*b*, panel 1890 may continue its movement and then fully traverse 749*b*, at which stage spring 745 may restore anterior section 742's head to its forward location. In anterior section 742's head's forward location, face 749*a* may block panel 1890 from traveling back in the direction of face 749*b*.

System apparatus may omit features shown and/or described in connection with illustrative systems. Embodiments may include features that are neither shown nor described in connection with the illustrative components, apparatus and/or systems. Features of illustrative components, apparatus and/or systems may be combined. For example, an illustrative embodiment may include features shown in connection with another illustrative embodiment.

The drawings show illustrative features of components, apparatus, products, systems and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures.

Thus, systems and methods are provided for partitioning systems that offer expandable room dividers that are compactly stored, readily transported, easily deployed and undeployed, and rapidly configured and re-configured. Persons skilled in the art will appreciate that the present invention can be practiced by other than the described embodiments, which are presented for purposes of illustration rather than of limitation. The present invention is limited only by the claims that follow.

What is claimed is:

1. A system for providing an expandable room divider, the system comprising:
a frame;
a non-releasable panel having a broad side; and
a plurality of movable panels,
wherein the frame is configured to:
retain the non-releasable panel; and
accommodate, stacked against the broad side of the non-releasable panel, the plurality of movable panels; and
a locking mechanism configured to selectively prevent, while in a locked state, and allow, while in an unlocked state, movement of the plurality of movable panels from the frame, the locking mechanism having a longitudinal axis and including:
a plunger disposed coaxial with the longitudinal axis, the plunger:
having a head at a first end; and
configured to travel along the longitudinal axis;
a spring configured to longitudinally bias the plunger to force the head to temporarily protrude from a body;
an actuator linked to the plunger at a second end of the plunger, the actuator configured to:
receive application of a force sufficient to counter the spring; and
draw the plunger back in a direction of the second end; and
the body configured to:
support the plunger, the spring and the actuator; and
receive the head as the plunger travels back in the direction of the second end;
wherein:
the locking mechanism is affixed to the frame, with the plunger and the longitudinal axis disposed parallel the broad side of the non-releasable panel;
a first face of the head prevents movement of the moveable panels away from the non-releasable panel when the head is maintained protruding from the body;
a second face of the head, obverse the first face, is configured to-receive a momentum directed transverse the longitudinal axis, transmit a component of the transverse momentum to the plunger, and allow movement of the moveable panels past the body in a direction toward the non-releasable panel; and
the actuator includes:
a surface configured to receive the force; and,
a stem that supports the surface;
the actuator linked to the plunger via a linkage that includes a pin disposed transverse the longitudinal axis, the pin extending through:
the plunger at the second end of the plunger; and
the stem away from the surface.

2. The system of claim 1 wherein:
the frame, in operation, maintains the non-releasable panel vertically upright;
the non-releasable panel is hinged along a vertical edge of the non-releasable panel to a movable panel of the plurality; and
the movable panels of the plurality are serially hinged, in an accordion-pleat configuration, together.

3. The system of claim 2 wherein:
the frame is a first frame;
the non-releasable panel is a first non-releasable panel; and
the locking mechanism is a first locking mechanism; and the system further comprises:
a second frame retaining a second non-releasable panel, the second frame, in operation, maintaining the second non-releasable panel vertically upright, the second non-releasable panel hinged along a vertical edge of the second non-releasable panel to a movable panel of the plurality; and
a second locking mechanism affixed to the second frame, the second locking mechanism configured to selectively prevent and allow movement, away from the second frame, of:
the plurality of movable panels; and
the first non-releasable panel.

4. The system of claim 1 wherein the stem includes, between the pin and the surface, a contour bulging convexly towards the head, the contour configured to interfere with an exterior facet of the body to progressively draw the linkage in the direction of the second end as the contour is progressively forced along the facet, the actuator swiveling about the pin, the surface of the actuator moving toward the body and toward the first end.

5. The system of claim 1 wherein:
the momentum directed transverse the longitudinal axis is received from a contact force transferred to the second face by a panel of the plurality as the panel moves toward the non-releasable panel;
the component of the transverse momentum is a longitudinal momentum directed toward the second end of the plunger; and
the second face is further configured to:
drive the head, opposite the spring bias, into the body; and,
thereby, allow the movement of the moveable panels past the body in a direction toward the non-releasable panel.

6. The system of claim 5 wherein, after the panel of the plurality moves past the body, the spring restores the head to protrude from the body.

7. The system of claim 5 wherein the second face includes a curvilinear region configured to receive the contact force.

8. The system of claim 1 wherein drawing the plunger back in the direction of the second end allows the moveable panels to move past the body in a direction away from the non-releasable panel.

9. The system of claim 1 wherein the actuator is disposed for application of the force as a foot pedal, the force applied by a user's foot.

10. The system of claim 1 wherein:
the first face of the head is parallel to and facing the broad side of the non-releasable panel; and
the first face of the head is spaced adjustably from the non-releasable panel to accommodate a thickness of all the movable panels stacked against the broad side of the non-releasable panel.

11. The system of claim 1 wherein the frame includes:
an exterior vertical wall of the system; and
a magnet disposed on the wall, the magnet configured to releasably adjoin the frame to a magnetic element of a component of another expandable room divider.

12. A system for selectively securing together room partitions and deploying room partitions, the system comprising:

a frame;
a non-releasable room partition;
a plurality of movable room partitions; and
a locking mechanism affixed to the frame,
wherein the frame is configured to:
permanently retain the non-releasable room partition; and
accommodate the plurality of movable room partitions that are selectively:
locked against the non-releasable room partition;
when unlocked from the frame, moved away from the non-releasable room partition and deployed to form an extended room divider; and
returned to the frame and secured against the non-releasable room partition when in a locked state;
the non-releasable room partition affixed to the frame;
the plurality of movable room partitions serially hinged, in an accordion-pleat configuration, together, to form a room partition of the plurality hinged to the non-releasable room partition; and
the locking mechanism:
including:
a spring biasing a plunger, the plunger with a head at a first end of the plunger, the plunger biased in a direction of the first end; and
an actuator linked to the plunger at a second end of the plunger; and
configured to selectively:
when the head protrudes anteriorly, biased by the spring, out of a body of the locking mechanism: prevent the movable room partitions from moving past the head in a direction away from the non-releasable room partition; and
when the head is retracted, by application of a force, back from a forward location in a direction of the second end of the plunger away from the first end, then:
when the force is applied by a user to the actuator away from the head, the force drawing the head back from the forward location:
allow the movable room partitions to move past the head in a direction away from the non-releasable room partition, allowing the releasable room partitions to be deployed into a configuration of an extended room divider; and
when the force is a contact force applied by a room partition of the plurality to a region of the head, the head at the forward location, the room partition moving in a direction toward the non-releasable room partition and encountering the head, the head receiving a momentum from the moveable partition, a component of the momentum directed back toward the second end of the plunger:
allow the room partition to move past the head in the direction toward the non-releasable room partition;
wherein the actuator includes:
a surface configured to receive the force applied by the user; and
a stem configured to support the surface, the stem with a length away from the surface, the length:
disposed athwart the second end of the plunger; and
linked to the second end via a linkage that includes a pin extending through the length and the second end and away from the surface.

13. The system of claim 12 wherein the frame maintains the non-releasable room partition vertically upright.

14. The system of claim 13 wherein the non-releasable room partition is hinged along a vertical edge.

15. The system of claim 12 wherein a room partition of the plurality is equipped with wheels below a lower edge of the room partition, the wheels disposed at opposing ends of a wheelbase oriented transverse a plane of a broad side of the room partition.

16. The system of claim 15 wherein the wheelbase of a first room partition of the plurality is longer than a wheelbase of another room partition of the plurality, wherein the other room partition is closer than the first room partition in serially hinged sequence to the non-releasable room partition.

17. The system of claim 12 wherein, after application of a contact force by a room partition of the plurality to a region of the head, the spring moves the plunger forward.

18. The system of claim 12 wherein:
the body is configured to:
support the plunger, the spring and the actuator; and
receive the head when the head is retracted back from the forward location; and
the stem includes, between the length and the surface, a contour bulging convexly in the direction of the first end of the plunger, the contour configured to interfere with an exterior facet of the body to progressively draw the linkage in the direction of the second end as the contour is progressively forced along the facet, the actuator swiveling about the pin, the surface moving toward the body and toward the first end.

19. The system of claim 12 wherein the locking mechanism is affixed adjustably to the frame, thereby spacing the head adjustably from the non-releasable room partition to accommodate:
reducing the plurality by removing one or more pairs from the plurality and hinging together the remaining pairs; and
augmenting the plurality by adding one or more pairs of hinged movable room partitions to the plurality, incorporating the one or more pairs into the plurality by hinging edges of the one or more pairs to unhinged edges of the plurality.

* * * * *